US006922970B2

(12) United States Patent
Iwamura et al.

(10) Patent No.: US 6,922,970 B2
(45) Date of Patent: Aug. 2, 2005

(54) APPARATUS FOR AUTOMATICALLY PACKAGING PRODUCTS

(75) Inventors: Yuji Iwamura, Minamiashigara (JP); Koichi Nakatogawa, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/408,278

(22) Filed: Apr. 8, 2003

(65) Prior Publication Data

US 2003/0188511 A1 Oct. 9, 2003

(30) Foreign Application Priority Data

Apr. 9, 2002 (JP) ..... 2002-106829
Apr. 9, 2002 (JP) ..... 2002-106841

(51) Int. Cl.[7] ..... B65B 57/02
(52) U.S. Cl. ..... 53/64; 53/53; 53/54
(58) Field of Search ..... 53/410, 591, 593, 53/218, 283, 284, 53, 493, 494, 500, 504, 139.5, 223, 228, 230, 54; 73/1.81, 1.79, 1.8, 306.8

(56) References Cited

U.S. PATENT DOCUMENTS 5,056,294 A * 10/1991 Focke ..... 53/201
5,371,931 A * 12/1994 Kawana et al. ..... 29/33 K
5,565,980 A * 10/1996 Davidson et al. ..... 356/237.2
5,638,657 A * 6/1997 Archer et al. ..... 53/253
5,703,688 A * 12/1997 Bell ..... 356/430
5,734,476 A * 3/1998 Dlugos ..... 356/628
5,802,803 A * 9/1998 Kitagawa et al. ..... 53/54
6,070,396 A * 6/2000 Rinaldi et al. ..... 53/504
6,137,577 A * 10/2000 Woodworth ..... 356/623
6,164,041 A * 12/2000 Focke et al. ..... 53/448
6,182,419 B1 * 2/2001 Karaki et al. ..... 53/430
6,323,452 B1 * 11/2001 Bonnet ..... 209/583
6,484,886 B1 * 11/2002 Isaacs et al. ..... 209/539

FOREIGN PATENT DOCUMENTS

JP 2000-310834 11/2000

* cited by examiner

*Primary Examiner*—Louis K. Huynh
*Assistant Examiner*—Brian Nash
(74) *Attorney, Agent, or Firm*—Sughrue Mion, PLLC

(57) ABSTRACT

An automatic packaging system has a first feed mechanism for feeding a light-shielded photosensitive roll in the direction indicated by the arrow A, an inspection mechanism for reading bar-code information from the light-shielded photosensitive roll, measuring and comparing dimensions of the light-shielded photosensitive roll with the bar-code information to inspect whether the light-shielded photosensitive roll is correct or wrong, a second feed mechanism for feeding the light-shielded photosensitive roll in the direction indicated by the arrow B if the light-shielded photosensitive roll judged as being correct, and a third feed mechanism for feeding the light-shielded photosensitive roll in the direction indicated by the arrow C.

14 Claims, 29 Drawing Sheets

APPARATUS FOR AUTOMATICALLY PACKAGING PRODUCTS

BACKGROUND OF THE INVENTION

1. Field of the Invention

The present invention relates to a method of and an apparatus for automatically packaging products having at least different product lengths or different side dimensions with packaging members.

2. Description of the Related Art

It has generally been customary in the art to manufacture various products having different dimensions such as lengths, side dimension, etc., and thereafter package the products with packaging members such as corrugated cardboard boxes or the like, producing packaged products.

One of the various known types of such products is in the form of a light-shielded photosensitive roll for use in the field of platemaking. The light-shielded photosensitive roll comprising an elongate photosensitive sheet wound around a core, a pair of flanged members as light-shielding members mounted respectively on the opposite ends of the rolled photosensitive sheet, and a light-shielding sheet (leader) wound around the rolled photosensitive sheet.

Various light-shielded photosensitive rolls have heretofore been proposed in the art. The applicant of the present application has filed a patent application on a process for easily manufacturing such a light-shielded photosensitive roll (see Japanese Laid-Open Patent Publication No. 2000-310834).

According to the process disclosed in the above patent application, as shown in FIG. 29 of the accompanying drawings, two disk-shaped light-shielding members (flanged members) 2 are attached respectively to opposite ends of a photosensitive material roll 1, and an elongate heat-shrinkable light-shielding leader 3 which is longitudinally shrinkable with heat is wound around the photosensitive material roll 1, the light-shielding leader 3 having and end fixed to the photosensitive roll 1 by tapes 4. Then, the photosensitive roll 1 is placed in a shrink tunnel (not shown) and heated to shrink the light-shielding leader 3. The light-shielding leader 3 is shrunk with heat to have its opposite edges 3*a* brought into close contact with the outer edges of the disk-shaped light-shielding members 2, thus manufacturing a light-shielded photosensitive roll (product) 5.

The light-shielded photosensitive roll 5 thus manufactured in the above production process is then introduced into a packaging process. In the packaging process, the light-shielded photosensitive roll 5 with damping members 6 held respectively against the opposite ends thereof is placed into a corrugated cardboard box 7, thus producing a packaged product 8.

In the packaging process, a facility is usually employed to package light-shielded photosensitive rolls 5 of one type in one size. However, the light-shielded photosensitive roll 5 is produced in different diameters. Specifically, there are available cores of different diameters, e.g., 2 inches and 3 inches, for supporting the photosensitive material roll 1 thereon, and the photosensitive material roll 1 is wound to different outside diameters on each of those cores. For example, the photosensitive material roll 1 is wound to four different outside diameters on cores having a diameter of 2 inches, and wound to two different outside diameters on cores having a diameter of 3 inches, so that a total of six different types of the light-shielded photosensitive roll 5 may be manufactured. In addition, the light-shielded photosensitive roll 5 is produced in different roll widths, and hard flanged members may be inserted as the disk-shaped light-shielding members 2. Therefore, the light-shielded photosensitive roll 5 is available in different package forms.

There has been a demand for the automatic packaging of light-shielded photosensitive rolls 5 having various different sizes. To meet the demand, there is known a system (hereinafter referred to as "first system") for shifting product information in a register in a computer (PC) in synchronism with the position of light-shielded photosensitive rolls 5 in the packaging process, and selecting corrugated cardboard boxes 7 and making facility changeovers based on the product information read from the register in working stations.

There is also known another system (hereinafter referred to as "second system") for selecting corrugated cardboard boxes 7 and making facility changeovers in working stations based on bar-code information read from bar codes that have been applied to light-shielded photosensitive rolls 5.

With the first system, however, the product information tends to be shifted out of synchronism with the actual position of light-shielded photosensitive rolls 5 in the packaging process. Consequently, it is likely for corrugated cardboard boxes 7 to be selected in error and also for facility changeovers to be made in error, resulting in a failure to perform the packaging process efficiently.

With the second system, different bar codes are liable to be applied to light-shielded photosensitive rolls 5 in the packaging process, with the result that corrugated cardboard boxes 7 may possibly be selected in error and facility changeovers may possibly be made in error.

Some of the light-shielded photosensitive rolls 5 which have been manufactured are not delivered directly to the packaging process, and are present as intermediate stock items. Such intermediate stock items cannot be well handled by the first system, and bar codes may often be applied in error to intermediate stock items in the second system. For these reasons, it is the usual practice for workers to manually inspect intermediate stock items for their appearance, but the manual inspection fails to increase the efficiency of the overall process.

The process of manufacturing the packaged product 8 includes many steps performed manually by the worker. Therefore, the manufacturing process is relatively complex and cannot easily be made more efficient.

For example, damping members 6 are manually supplied by the worker from damping member magazines that are positioned one on each side of the light-shielded photosensitive roll 5, and inserted into position on the opposite ends of the light-shielded photosensitive roll 5. The manual handling of damping members 6 is poor in efficiency. In addition, if many types of light-shielded photosensitive rolls 5 are employed, then since the worker needs to choose correct damping members 6 for each of the light-shielded photosensitive rolls 5, the efficiency with which to apply damping members 6 becomes considerably low.

Corrugated cardboard boxes 7 are not available for respective different types of light-shielded photosensitive rolls 5, but light-shielded photosensitive rolls 5 are housed in available corrugated cardboard boxes 7 with spacers interposed therebetween. The spacers are available in three types, i.e., spacers that are 30 mm thick, spacers that are 20 mm thick, and spacers that are 10 mm thick. The worker pick out and insert spacers that match the gaps between the corrugated cardboard box 7 and the light-shielded photosensitive roll 5 to be placed therein. Accordingly, it is a considerably complex and time-consuming task to insert spacers snugly between the corrugated cardboard box 7 and the light-shielded photosensitive roll 5.

SUMMARY OF THE INVENTION

It is a general object of the present invention to provide a method of and an apparatus for automatically packaging products efficiently by recognizing product information easily and reliably with a simple process and arrangement.

A major object of the present invention is to provide a method of and an apparatus for automatically packaging various products of different dimensions efficiently with a simple process and arrangement.

According to the present invention, after a product manufactured in a preceding process is fed along a first feed direction, bar-code information is read from the product, and the product is measured for dimensions. The measured dimensions are compared with the bar-code information to determine whether the product is correct or wrong. If the product is judged as being correct, the product is fed in a second feed direction transverse to the first feed direction, and thereafter fed along a third feed direction parallel to the first feed direction. Then, the product is automatically packaged with a packaging member.

According to the present invention, as described above, a product is measured for dimensions and checked against bar-code information read from the product. Only those products whose dimensions match the bar-code information are delivered in the second feed direction. Accordingly, the selection of a packaging member and a facility changeover depending on the product are free from errors, and the product can be packaged efficiently and automatically with a simple process and arrangement.

According to the present invention, furthermore, after corresponding dampers are mounted on the opposite ends of a product, a given number of spacers are automatically placed near one of the ends of the product. A desired packaging member is selected from a packaging member supply mechanism depending on the product dimensions, and fed to a box assembly station. In the box assembling station, the product is superposed on the packaging member, and the packaging member is automatically folded over the product, thereby packaging the product with the packaging member.

The process of mounting dampers and placing spacers is automatized, and various products of different dimensions can be packaged automatically and efficiently, resulting in an increase in the efficiency with which to package the products.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
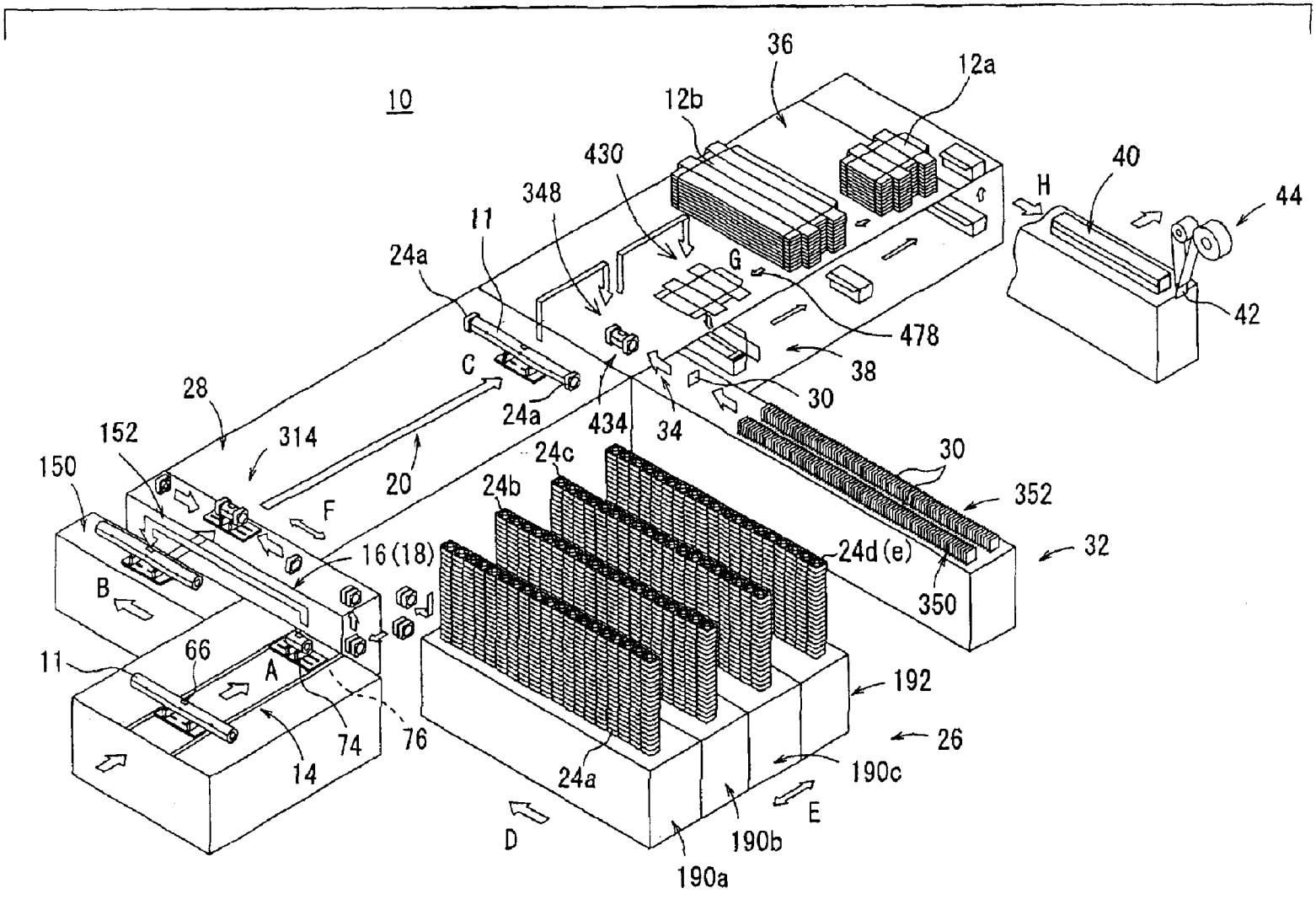
FIG. 1 is a schematic perspective view of an automatic packaging system for carrying out a method of automatically packaging a product according to the present invention.
Figure 2:
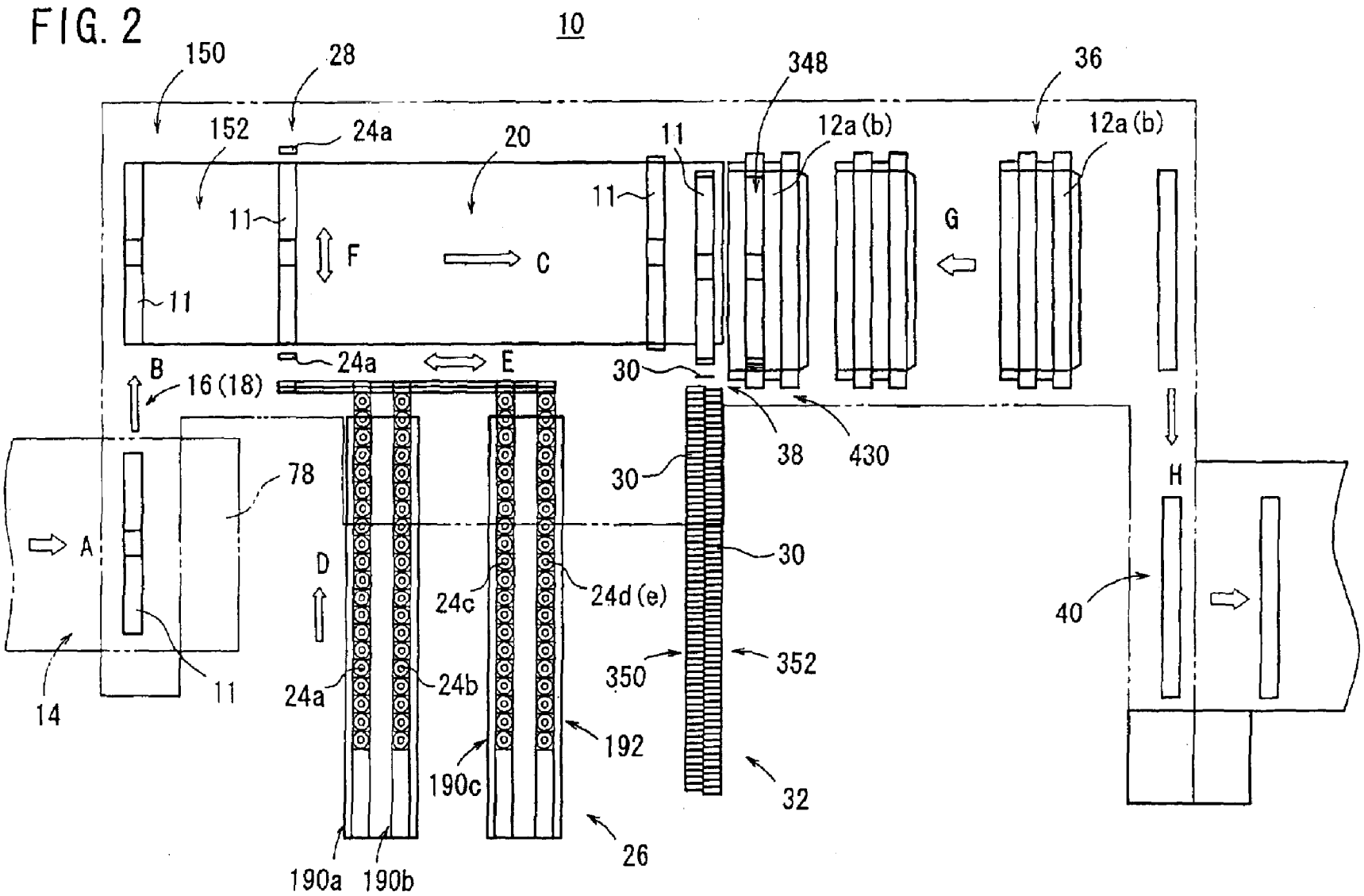
FIG. 2 is a schematic plan view of the automatic packaging system.

FIG. 1 shows in schematic perspective an automatic packaging system 10 for carrying out a method of automatically packaging a product according to the present invention, and FIG. 2 shows in schematic plan the automatic packaging system.

As shown in FIGS. 1 and 2, the automatic packaging system 10 serves to automatically package various light-shielded photosensitive rolls (products) 11 having at least different product lengths or side dimensions with corrugated cardboard boxes (packaging members) 12*a* or 12*b* having two types of different dimensions, for example.

The automatic packaging system 10 has a first feed mechanism 14 for feeding a light-shielded photosensitive roll 11 manufactured in a preceding process along a first feed direction (indicated by the arrow A), an inspection mechanism 16 for reading bar-code information from the light-shielded photosensitive roll 11 fed in the first feed direction, measuring and comparing dimensions of the light-shielded photosensitive roll 11 with the bar-code information to inspect whether the light-shielded photosensitive roll 11 is correct or wrong, a second feed mechanism 18 for feeding the light-shielded photosensitive roll 11 along a second feed direction (indicated by the arrow B) which is transverse to the first feed direction, if the light-shielded photosensitive roll 11 judged as being correct, and a third feed mechanism 20 for feeding the light-shielded photosensitive roll 11 fed in the second feed direction along a third feed direction (indicated by the arrow C) which is parallel to the first feed direction. The third feed mechanism 20 provides a single first feed line for feeding various light-shielded photosensitive rolls 11 of different dimensions in the third feed direction C.

The automatic packaging system 10 also has a damper supply mechanism 26 for accommodating and supplying a plurality of different dampers 24*a*, 24*b*, 24*c*, and 24*d* (or 24*e*) depending on the dimensions of the light-shielded photosensitive roll 11 being fed, a damper mounting mechanism 28 for automatically mounting corresponding dampers 24*a*, 24*b*, 24*c*, 24*d*, or 24*e* on opposite ends of the light-shielded photosensitive roll 11, a spacer supply mechanism 32 for accommodating spacers 30 to be placed near one end of the light-shielded photosensitive roll 11, a spacer inserting mechanism 34 for automatically positioning a desired number of spacers 30 on one end of the light-shielded photosensitive roll 11 on which the dampers 24*a*, 24*b*, 24*c*, 24*d*, or 24*e* are mounted, a packaging member supply mechanism 36 for accommodating corrugated cardboard boxes 12*a*, 12*b* having different dimensions, a box assembling mechanism 38 for automatically folding a corrugated cardboard box 12*a* or 12*b* over the light-shielded photosensitive roll 11 that is superposed on the corrugated cardboard box 12*a* or 12*b* for thereby packaging the light-shielded photosensitive roll 11 with the corrugated cardboard box 12*a* or 12*b*, and a label applying mechanism 44 for applying a bar-code label 42 to a side panel of a packaged product 40 which comprises the light-shielded photosensitive roll 11 housed in the corrugated cardboard box 12*a* or 12*b*, the bar-code label 42 bearing printed information about the type (including dimensions and product type) of the light-shielded photosensitive roll 11 housed in the corrugated cardboard box 12*a* or 12*b*.

Figure 3:
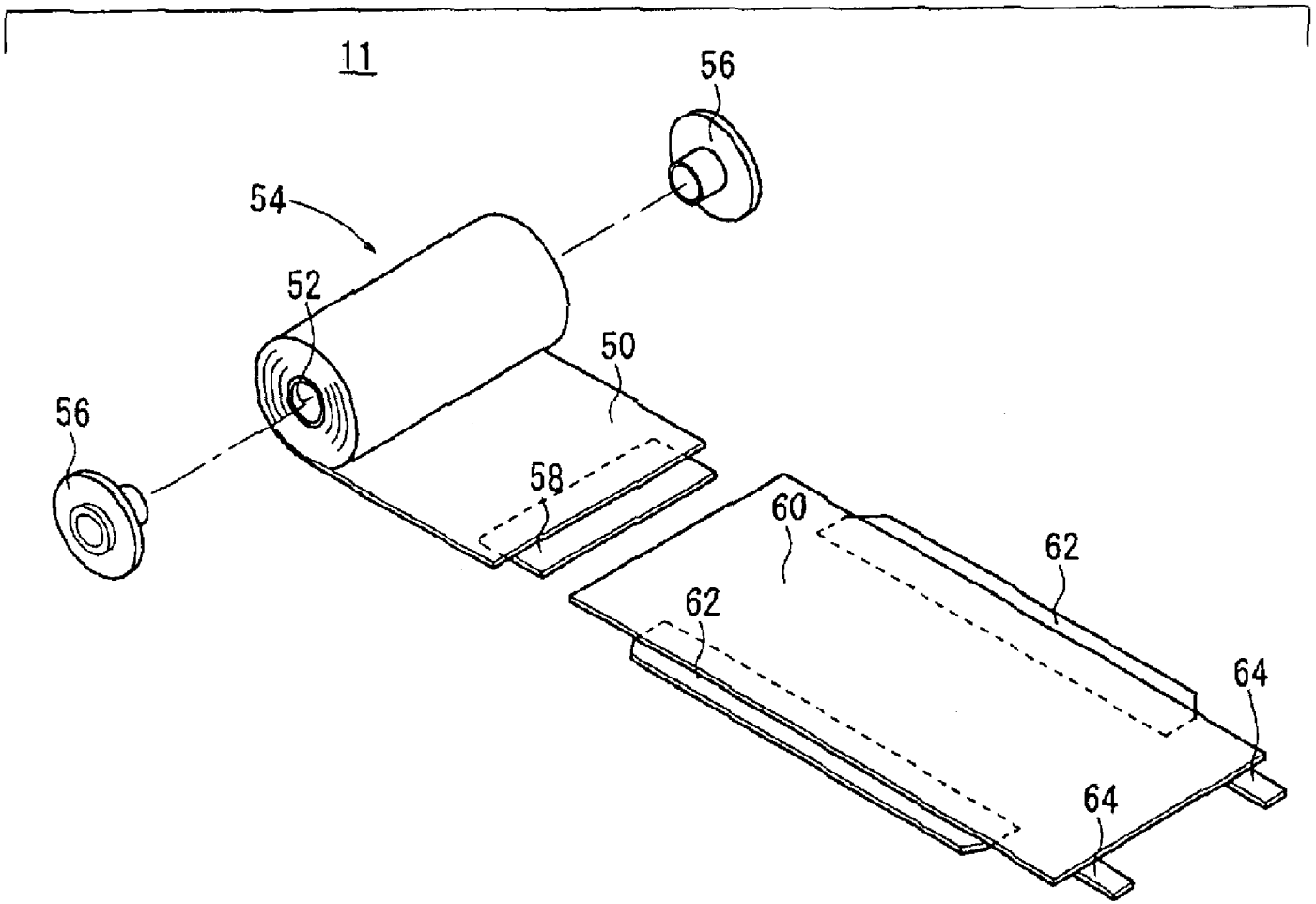
FIG. 3 is an exploded perspective view of a light-shielded photosensitive material roll to be packaged by the automatic packaging system.

As shown in FIG. 3, the light-shielded photosensitive roll 11 is manufactured as follows: A photosensitive material roll 54 is produced by winding an elongate photosensitive sheet 50 around a core 52. Two light-shielding flanged members 56 are attached to the respective opposite ends of the photosensitive material roll 54. A light-shielding leader 60 is then applied to the end of the photosensitive sheet 50 by joining tapes 58. Then, the light-shielding leader 60 is wound around the photosensitive material roll 54, and light-shielding shrink films 62 of the light-shielding leader 60 are fused (bonded) with heat to the opposite outer edges of the photosensitive material roll 54, thus producing the light-shielded photosensitive roll 11. The end of the light-shielding leader 60 is fastened to the outer circumferential surface thereof by end retainer tapes 64. A bar code 66 (see FIG. 1) which bears printed information about the type of the photosensitive material roll 54 is applied to the outer circumferential surface of the light-shielding leader 60. If necessary, hard flanges (not shown) may be mounted on the respective opposite ends of the light-shielded photosensitive roll 11.

Figure 4:
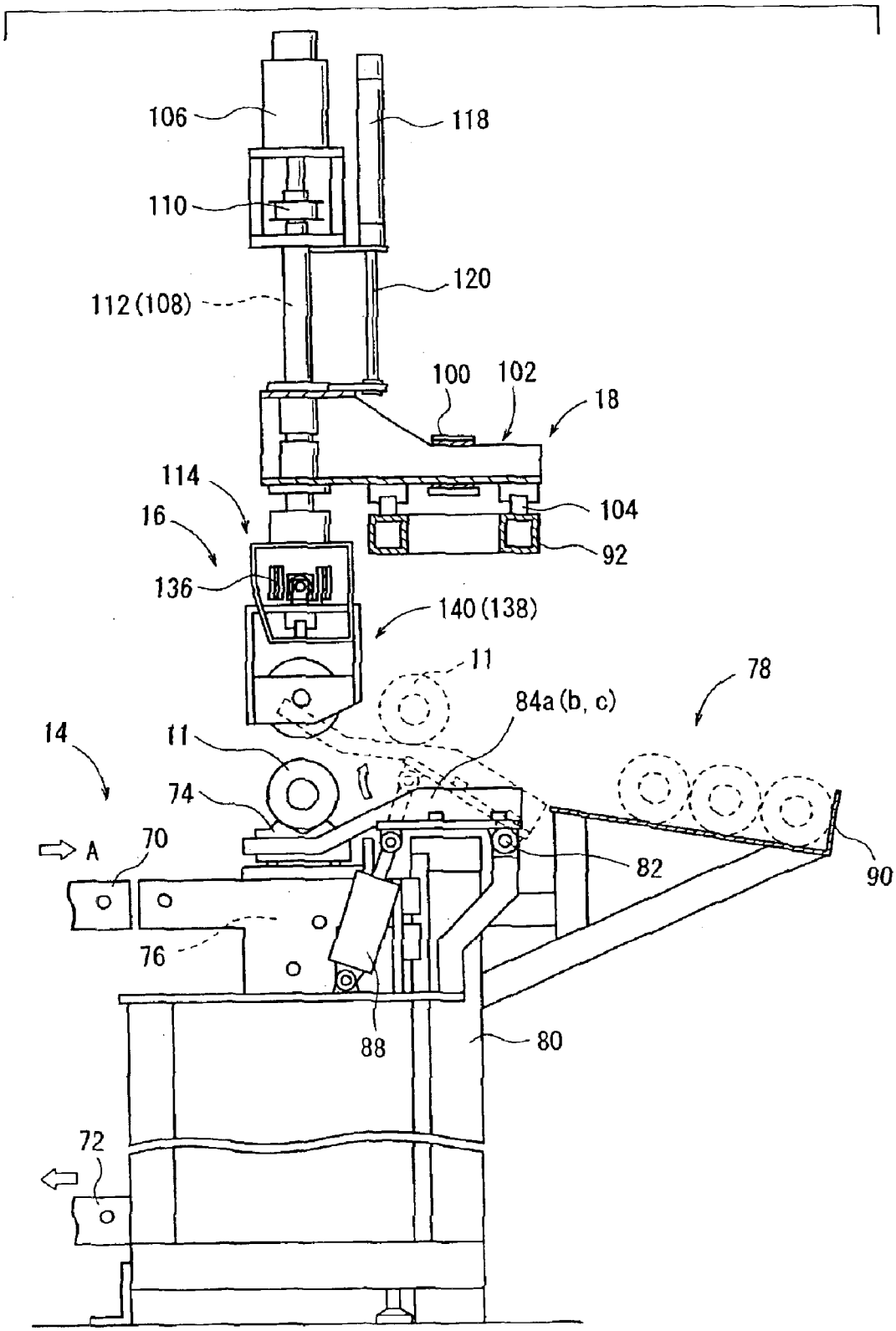
FIG. 4 is a side elevational view of a first feed mechanism of the automatic packaging system.

As shown in FIG. 4, the first feed mechanism 14 comprises upper and lower feed conveyors 70, 72 which are vertically spaced from each other and extend parallel to each other, and a plurality of pallets 74 for carrying light-shielded photosensitive rolls 11, respectively. The first feed mechanism 14 also has a lifter 76 disposed in a downstream region along the direction A for transferring pallets 74 from the upper feed conveyor 70 to the lower feed conveyor 72. A rejecting mechanism 78 is disposed near the lifter 76 for rejecting light-shielded photosensitive rolls 11 from the first feed mechanism 14 which have been judged as being in error by the inspection mechanism 16 or judged as being defective by another inspection mechanism.

Figure 5:
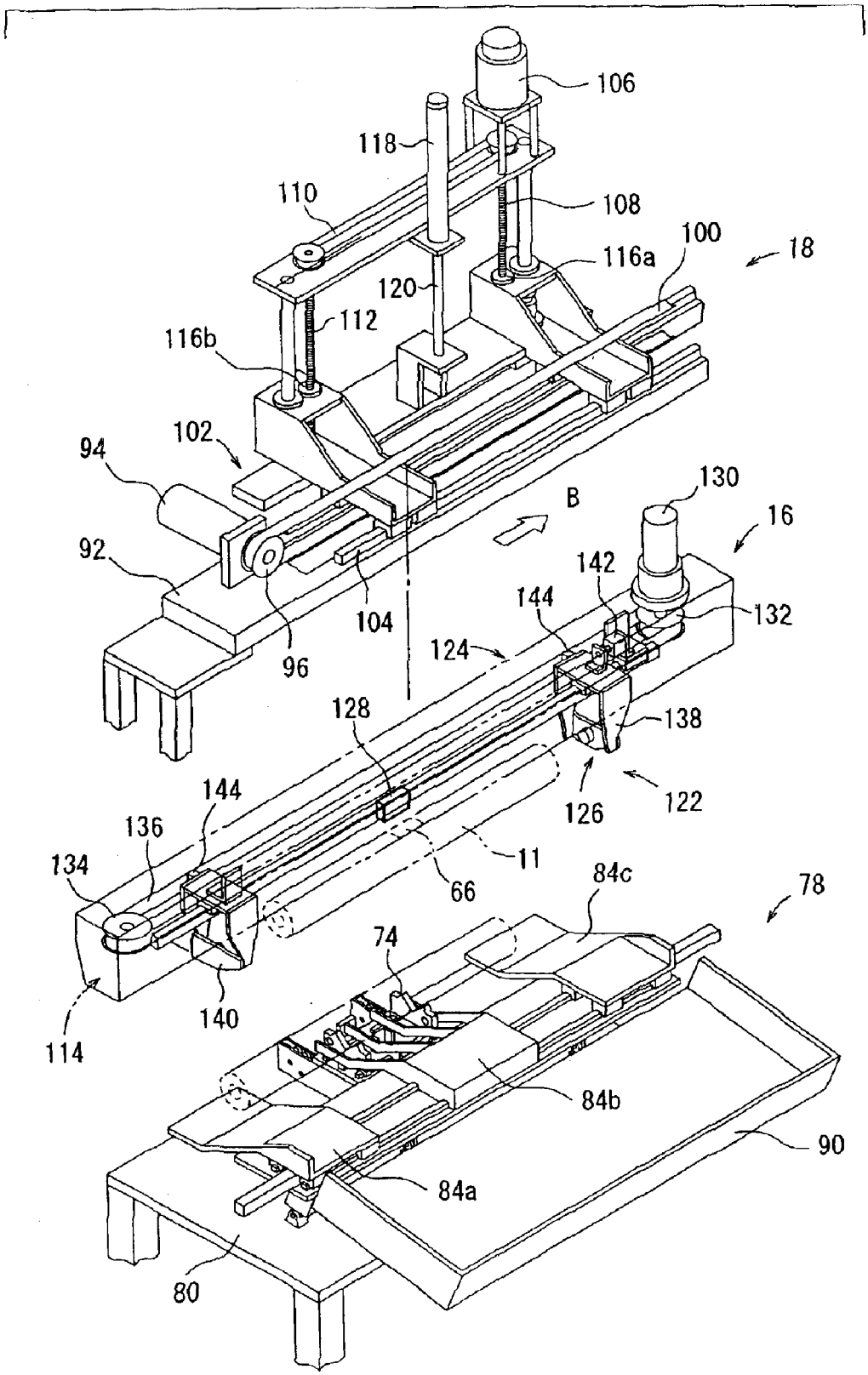
FIG. 5 is a fragmentary exploded perspective view of the first feed mechanism, an inspection mechanism, and a second feed mechanism.

As shown in FIGS. 4 and 5, the rejecting mechanism 78 has a plurality of arms 84*a*, 84*b*, 84*c* swingably supported on a mount base 80 of the first feed mechanism 14 by a pivot shaft 82. The arm 84*b* has a plurality of (e.g., four) fingers positioned out of interference with the pallet 74 and capable of supporting a light-shielded photosensitive roll 11 thereon. The arms 84*a*, 84*b*, 84*c* are angularly movable from a horizontal attitude to an upwardly inclined attitude by a cylinder 88, and adjustably spaced from each other depending on the axial length of the light-shielded photosensitive roll 11 supported thereon. When the arms 84*a*, 84*b*, 84*c* are angularly lifted from the horizontal attitude to the upwardly inclined attitude, the light-shielded photosensitive roll 11 supported on the arms 84*a*, 84*b*, 84*c* are discharged along the arms 84*a*, 84*b*, 84*c* onto a stack tray 90 disposed alongside of the arms 84*a*, 84*b*, 84*c*.

Figure 6:
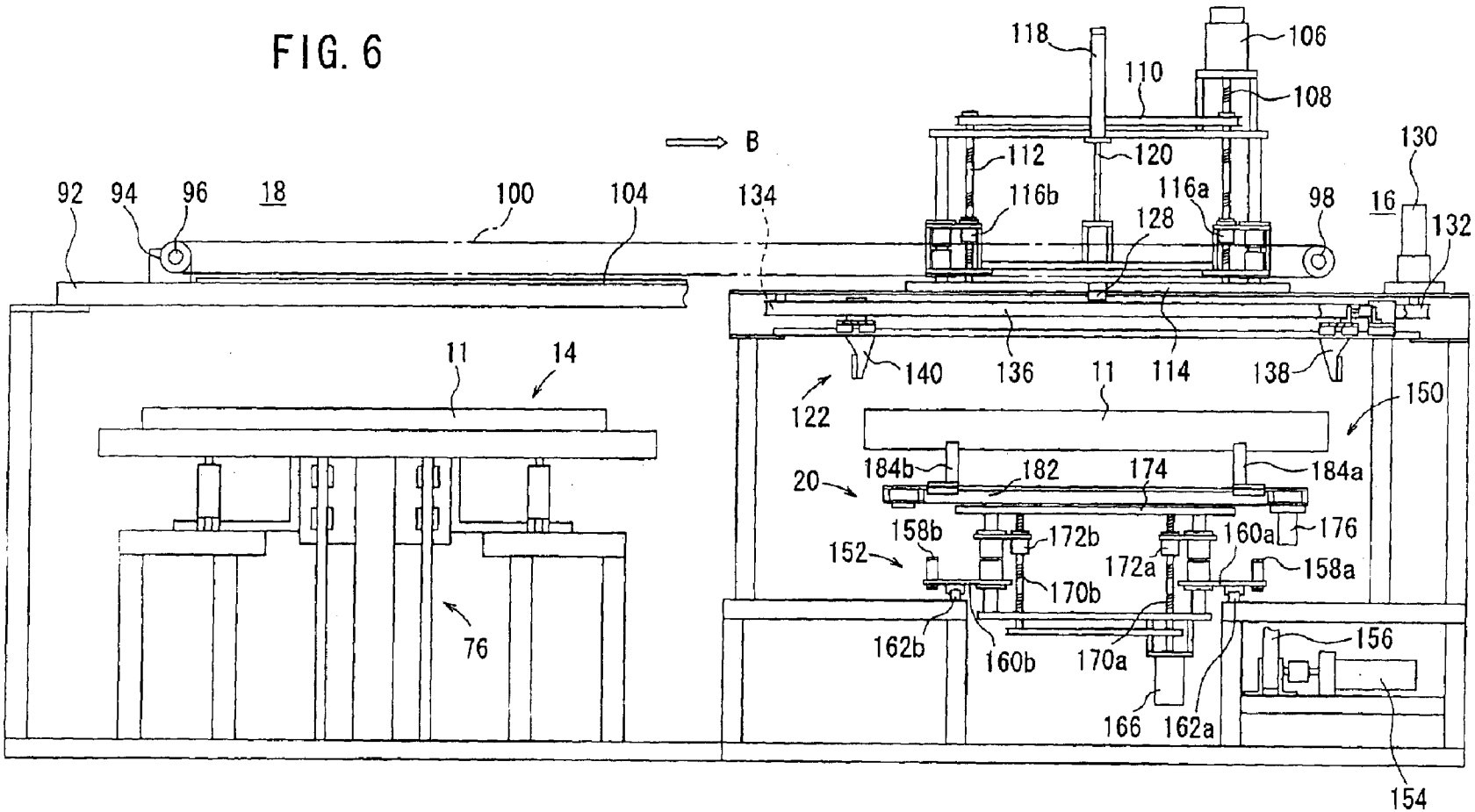
FIG. 6 is a fragmentary front elevational view of the first feed mechanism, the second feed mechanism, and a third feed mechanism.

The inspection mechanism 16 is disposed upwardly of the lifter 76 and is movable by the second feed mechanism 18. As shown in FIGS. 4 through 6, the second feed mechanism 18 has a rotary actuator 94 fixed to an end (on the side of the first feed mechanism 14) of a support base 92 which extends in the direction B. A belt 100 is trained around a drive pulley 96 coupled to the rotary actuator 94 and a driven pulley 98 disposed in a downstream region along the direction B. To the belt 100, there is secured a movable base 102 that is guided by guide rails 104 mounted on the support base 92 and extending in the direction B.

A rotary actuator (servomotor) 106 is mounted on the movable base 102 and has a vertical drive shaft coaxially coupled to a first ball screw 108 to which a second ball screw 112 is operatively connected by a belt and pulley means 110. The first and second ball screws 108, 112 are threaded through respective nuts 116*a*, 116*b* mounted on a vertically movable frame 114. A balancer cylinder 118 is fixedly mounted on the movable base 102 and has a downwardly extending rod 120 connected to the vertically movable frame 114.

The inspection mechanism 16 is mounted on the vertically movable frame 114. The inspection mechanism 16 comprises a gripper 122 for gripping the longitudinally opposite ends of the light-shielded photosensitive roll 11, an axial length measuring unit 124 for measuring the axial length of the light-shielded photosensitive roll 11, a diameter measuring unit 126 for measuring the inside and outside diameters of the light-shielded photosensitive roll 11, and a bar-code reader 128 for reading bar-code information of the bar code 66 applied to the light-shielded photosensitive roll 11.

The gripper 122 has a rotary actuator (servomotor) 130 mounted on an end of the vertically movable frame 114 and oriented downwardly. A belt 136 is trained around a drive pulley 132 coupled to the rotary actuator 130 and a driven pulley 134 supported on the opposite end of the vertically movable frame 114. The belt 136 has two parallel stretches extending in the direction B, and a first clamp 138 is fixed to an end of one of the stretch of the belt 136 and a second clamp 140 is fixed to an opposite end of the other stretch of the belt 136.

The first clamp 138 supports thereon a cylinder 142 for pressing the first clamp 138 in the axial direction of the light-shielded photosensitive roll 11. The axial length measuring unit 124 has a pair of magnescales 144 mounted respectively on the first and second clamps 138, 140, and calculates the axial length of the light-shielded photosensitive roll 11 from the distances that the magnescales 144 have moved.

Figure 7:
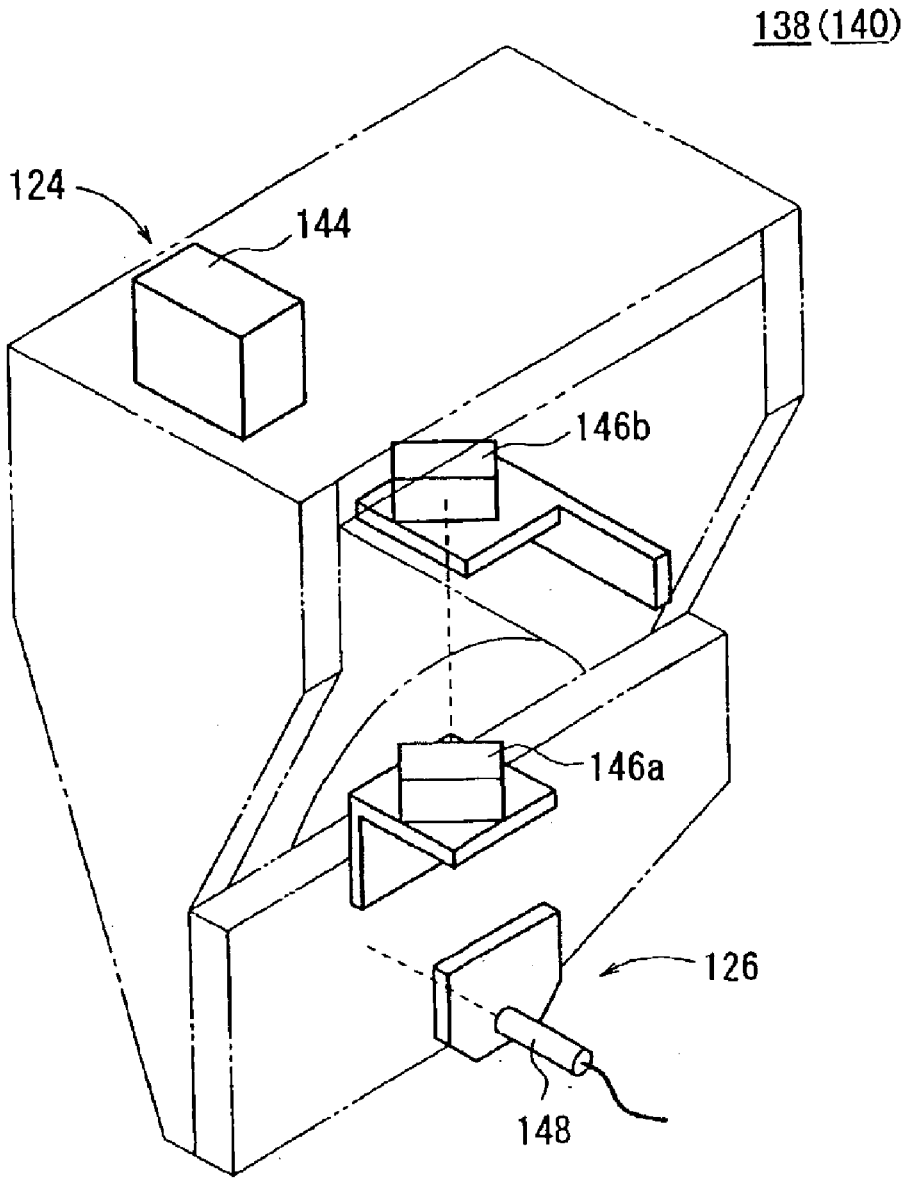
FIG. 7 is a perspective view of a first clamp of the inspection mechanism.

As shown in FIG. 7, the diameter measuring unit 126 comprises a sensor mounted on each of the first and second clamps 138, 140 and having a light-emitting element 146*a* and a light-detecting element 146*b* for detecting an end of a hard flange, and a light-emitting/detecting sensor 148 for detecting entered and blocked light at each of the opposite ends of the light-shielded photosensitive roll 11 to measure the inside and outside diameters thereof when the first and second clamps 138, 140 are lowered.

Figure 8:
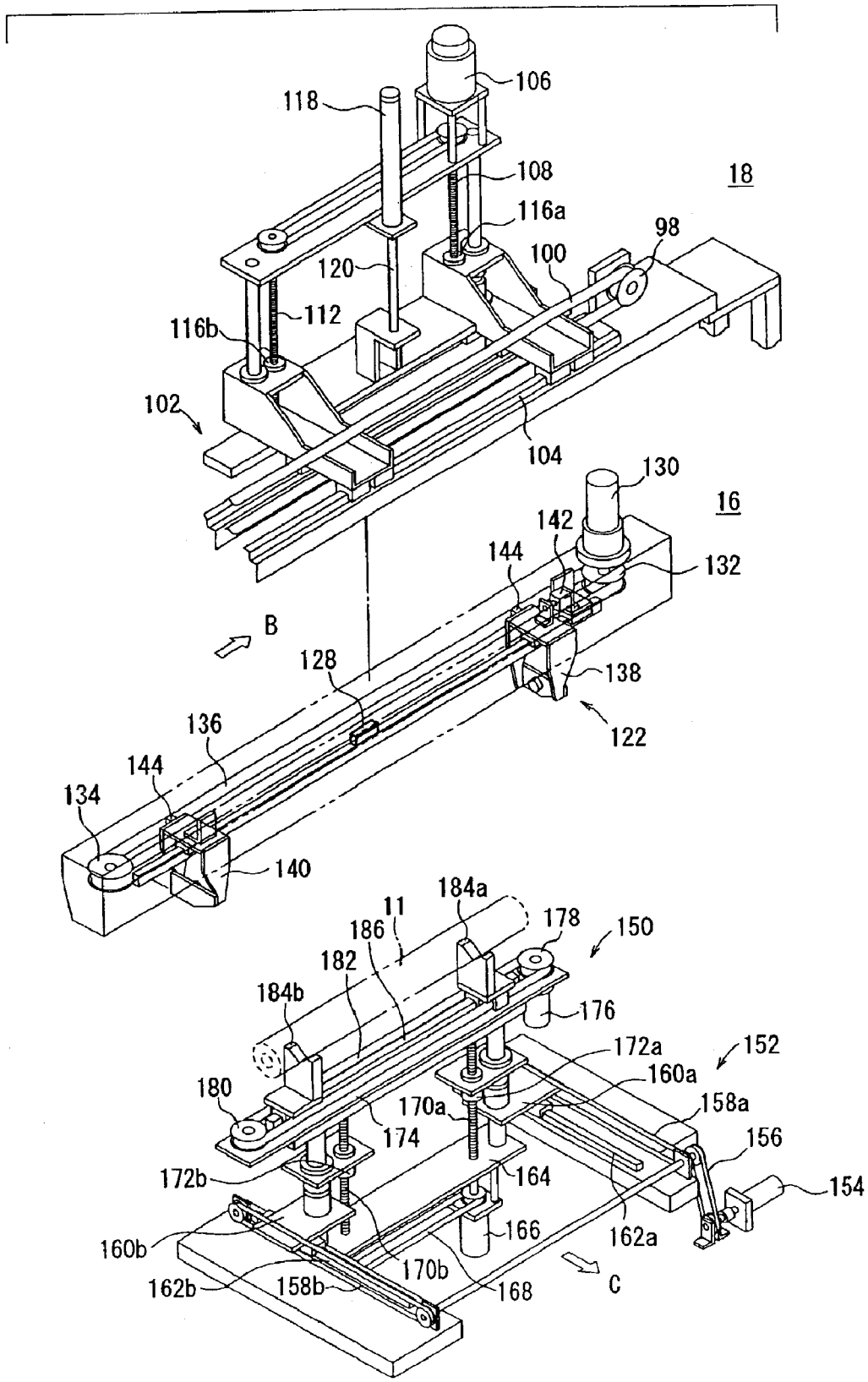
FIG. 8 is a fragmentary exploded perspective view of a product charger, a product feeder, the inspection mechanism, and the second feed mechanism.

As shown in FIGS. 6 and 8, the third feed mechanism 20 has a product charger 150 and a product feeder 152 which are disposed below the inspection mechanism 16 at a terminal end of the feed line along the direction B. The product charger 150 can support a light-shielded photosensitive roll 11 fed by the inspection mechanism 16 and also can charge a desired light-shielded photosensitive roll 11 independently of the inspection mechanism 16. The product feeder 152 can feed the light-shielded photosensitive roll 11 in the direction C and automatically load the light-shielded photosensitive roll 11 in the damper mounting mechanism 28.

The product feeder 152 has a rotary actuator 154 operatively coupled by a drive belt 156 to a pair of laterally spaced belts 158*a*, 158*b* extending parallel to each other and circulatingly movable along the direction C. Movable bases 160*a*, 160*b* are fixed to the respective belts 158*a*, 158*b*, and slidably supported on respective guide rails 162*a*, 162*b* extending in the direction C.

The movable bases 160*a*, 160*b* are fixedly coupled to a common base 164 which supports thereon a rotary actuator 166 that is operatively coupled to third and fourth ball screws 170*a*, 170*b* by a belt and pulley means 168. The third and fourth ball screws 170*a*, 170*b* vertically extend parallel to each other and are threaded respectively through nuts 172*a*, 172*b* which are fixedly mounted on a vertically movable base 174 of the product charger 150.

A rotary actuator 176 is mounted on an end of the vertically movable base 174 and has a vertically extending drive shaft connected to a drive pulley 178. A belt 182 is trained around the drive pulley 178 and a driven pulley 180 which is supported on the opposite end of the vertically movable base 174. The belt 182 has two parallel stretches extending in the direction B, and two rests 184*a*, 184*b* are fixed to respective opposite ends of the stretches of the belt 182. The rests 184*a*, 184*b* are slidably supported on a guide rail 186 extending in the direction B and fixedly mounted on the vertically movable base 174, and can be moved toward and away from each other when the rotary actuator 176 is energized.

As shown in FIG. 1, the damper supply mechanism 26 has dedicated magazines 190*a*, 190*b*, 190*c* for individually accommodating dampers 24*a*, 24*b*, and 24*c* that are frequently used and a common magazine 192 for selectively accommodating dampers 24*d* or 24*e* that are less frequently used.

Figure 9:
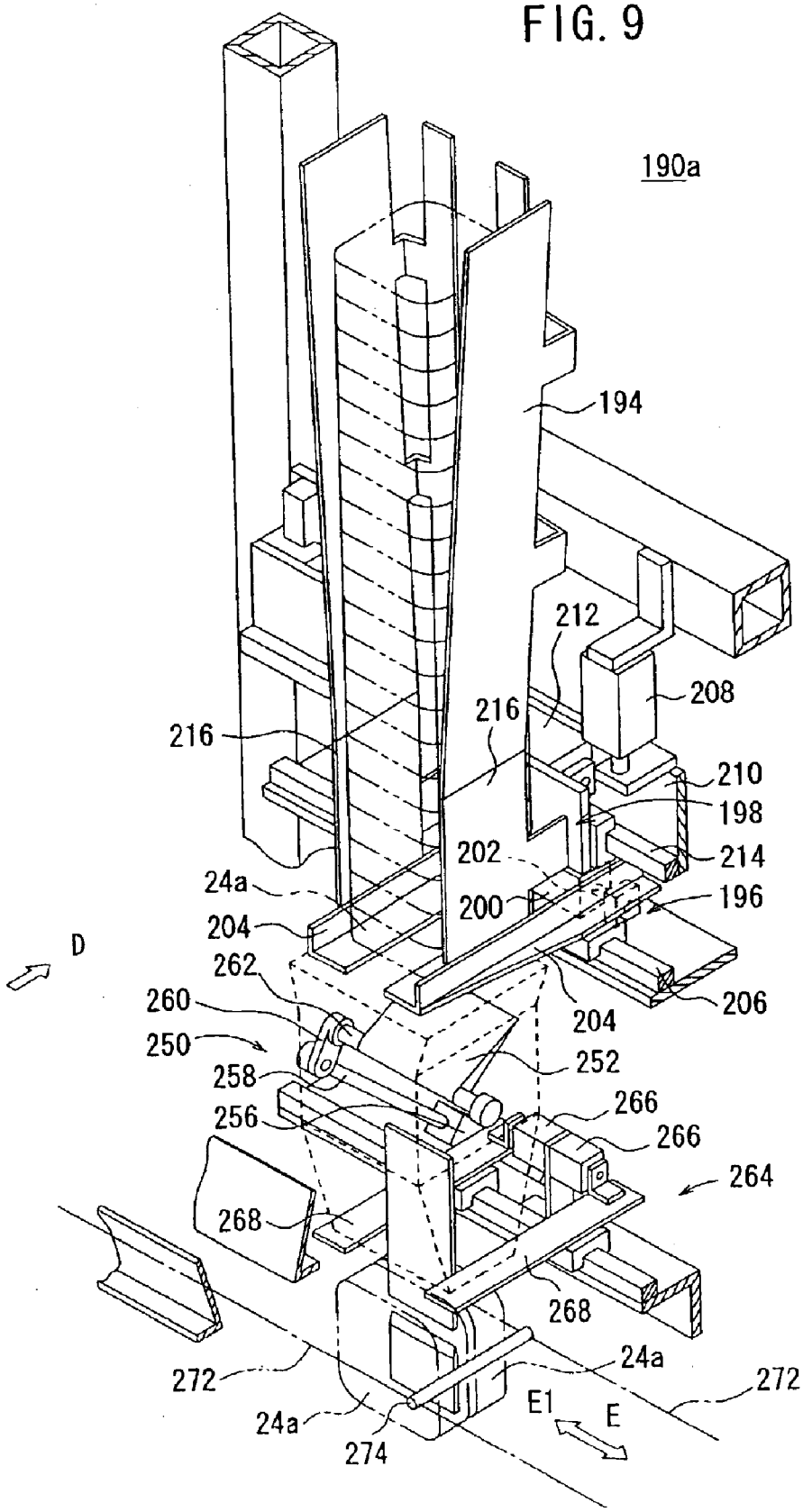
FIG. 9 is a fragmentary perspective view of a dedicated magazine of a damper supply mechanism.
Figure 10:
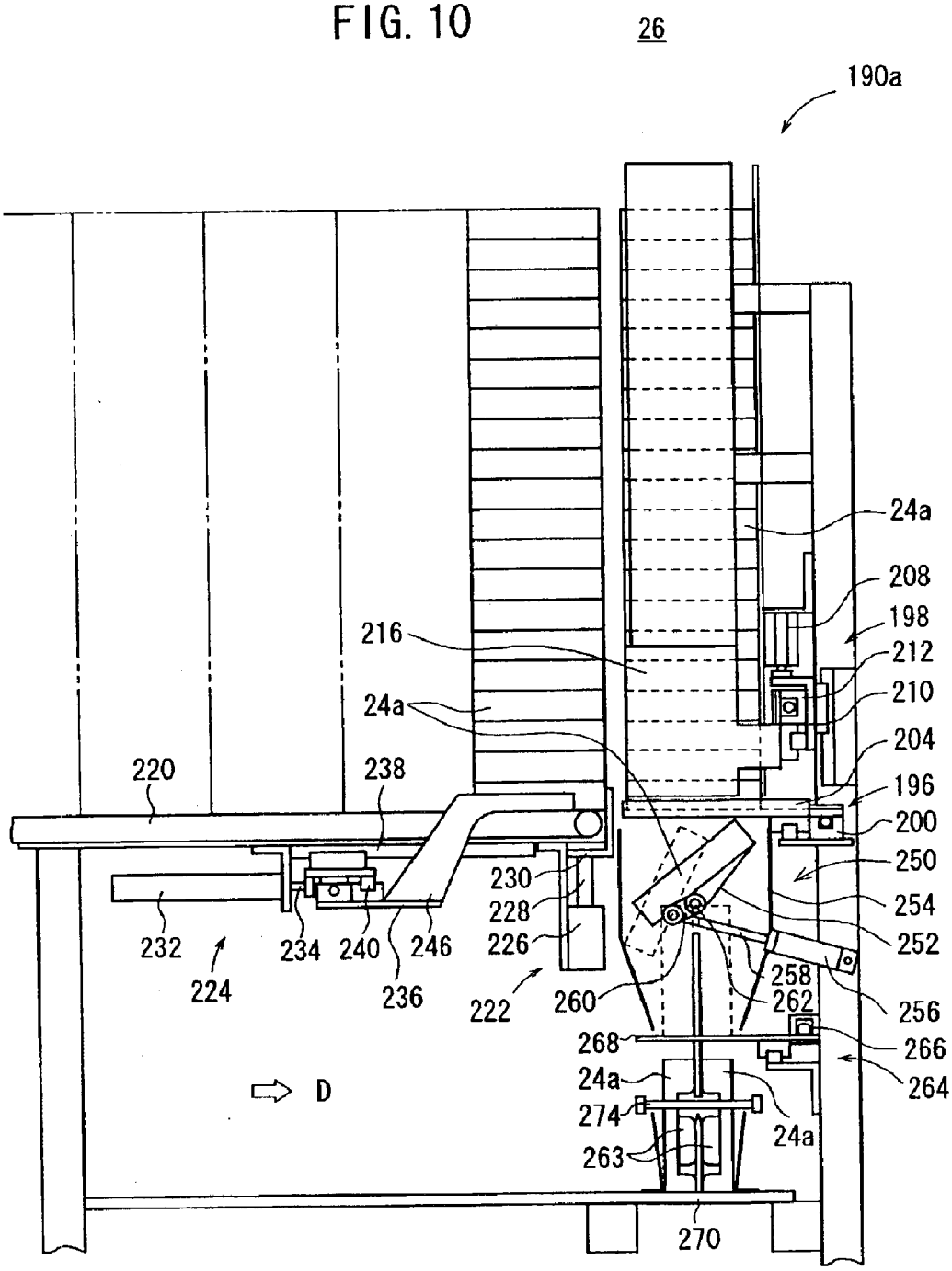
FIG. 10 is a side elevational view of the dedicated magazine.
Figure 11:
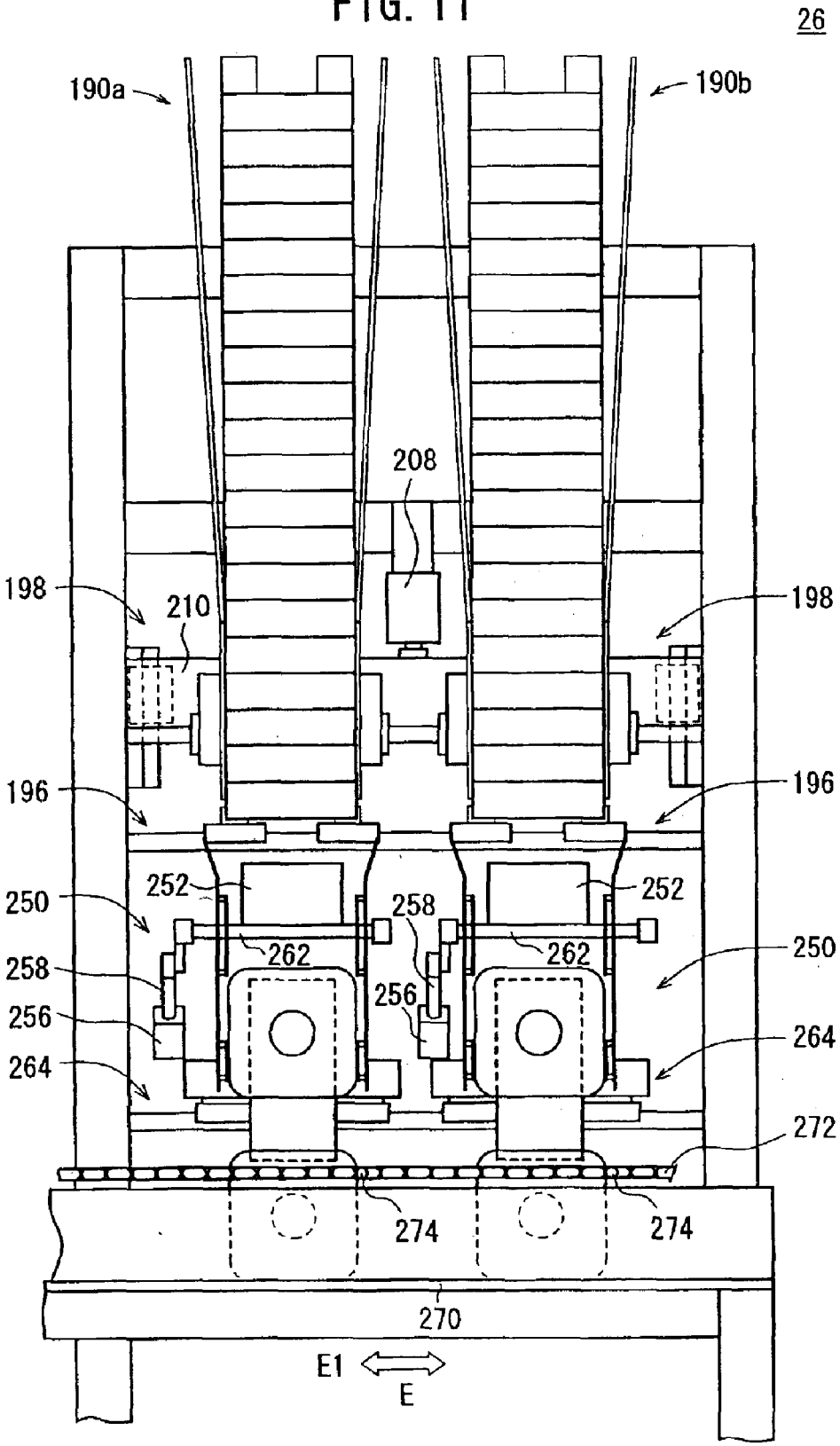
FIG. 11 is a front elevational view of the dedicated magazine.

As shown in FIGS. 9 through 11, the dedicated magazine 190*a* accommodates a horizontal array of stacks of dampers 24*a* in the direction indicated by the arrow D, each stack comprising a vertical array of dampers 24*a* arranged in the same attitude. The stack of dampers 24*a* which is positioned at the foremost end of the horizontal array is positioned by a guide plate 194. The damper 24*a* disposed in a lowermost position in the foremost stack can be supported by a shutter 196, and the second lowermost damper 24*a* and other dampers 24*a* thereabove can be held by a damper holder 198.

Figure 12:
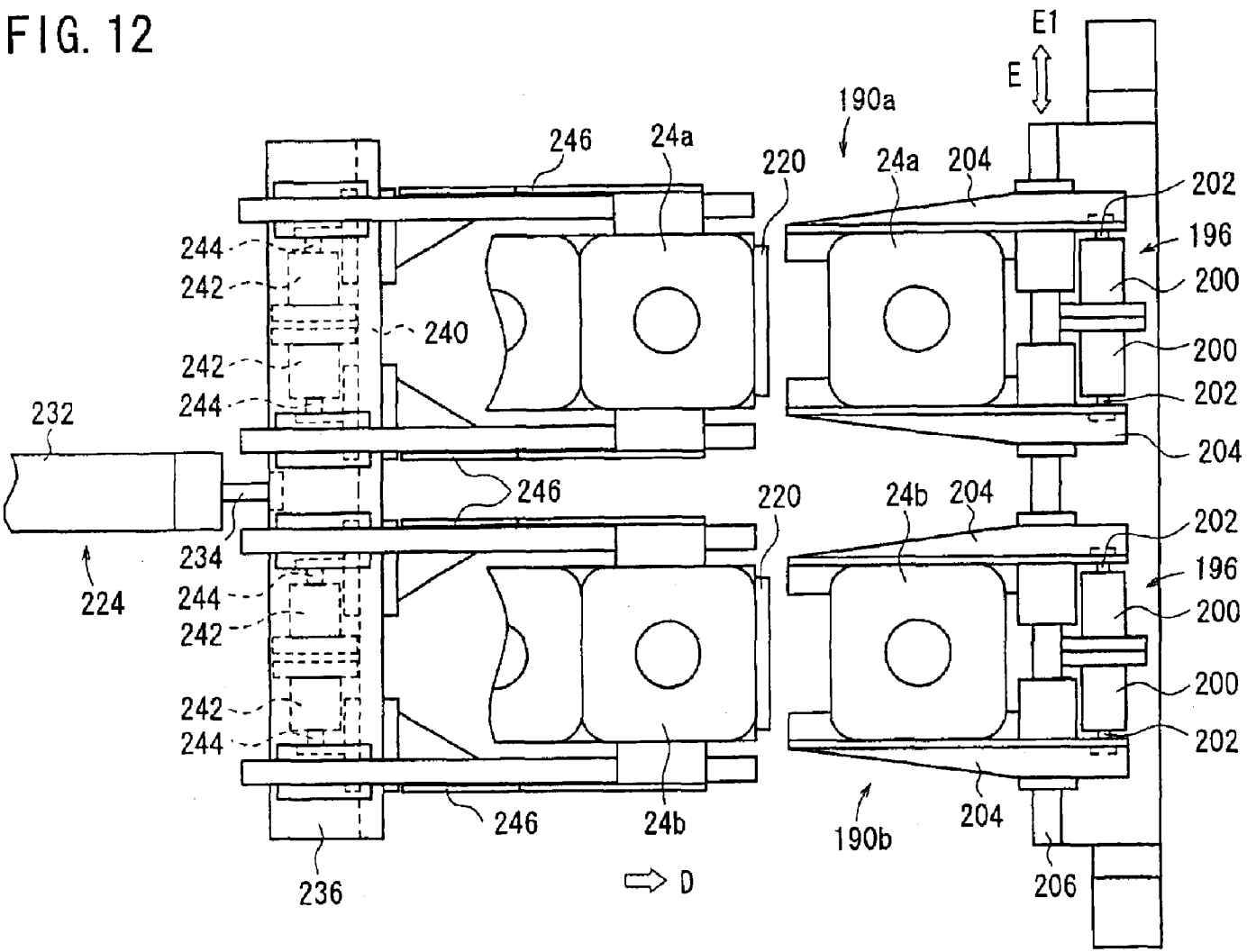
FIG. 12 is a plan view of the dedicated magazine.

As shown in FIGS. 9, 10, and 12, the shutter 196 has a pair of cylinders 200 disposed coaxially with each other and oriented away from each other. The rods 200 have respective rods 202 projecting outwardly and fixed to respective angles 204 having an L-shaped cross section. The angles 204 are slidably supported on a guide rail 206 for movement toward and away from each other in the direction indicated by the arrow E. The angles 204 support opposite sides and opposite lower end regions of the lowermost damper 24*a* in the stack positioned at the foremost end of the horizontal array, thus holding all the dampers 24*a* in the stack.

As shown in FIGS. 9 through 11, the damper holder 198 has a vertically movable plate 210 which is vertically movable by a lifting/lowering cylinder 208. The vertically movable plate 210 supports on an end thereof a pair of cylinders 212 oriented away from each other and disposed coaxially with each other. To the cylinders 212, there are connected respective grip plates 216 movable along a guide rail 216 toward and away from each other in the direction indicated by the arrow E. The grip plates 216 can grip three sides, i.e., opposite sides and another side, of the second lowermost damper 24*a* and other dampers 24*a* thereabove. The vertically movable plate 210 also supports another damper holder 198 for holding the dampers 26*b* accommodated in the dedicated magazine 190*b*.

Figure 13:
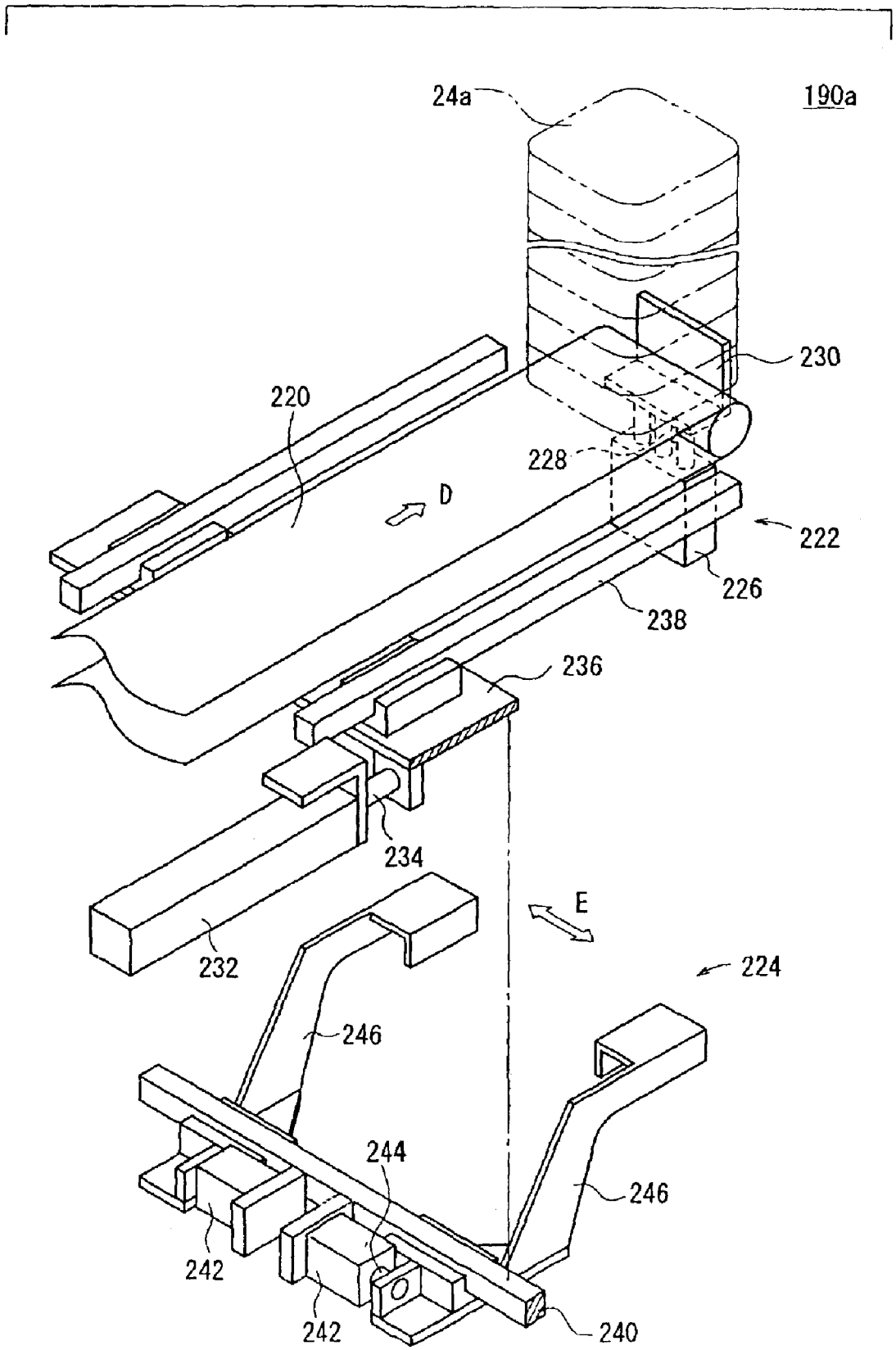
FIG. 13 is a fragmentary exploded perspective view of a damper delivery unit and a conveyor of the dedicated magazine.

As shown in FIGS. 10, 12, and 13, the second foremost stack of dampers 24*a* and following stacks of dampers 24*a* which are arrayed in the direction D are fed by a conveyor 220 in the direction D. The conveyor 220 is associated with a stopper 222 for positioning the foremost stack in the direction D of dampers 24*a* on the conveyor 220 and a damper delivery unit 224 for delivering the foremost stack of dampers 24*a* to the shutter 196 in a delivery position.

The stopper 222 has a cylinder 226 positioned at the tip end of the conveyor 220 and having upwardly extending rods 228 fixed to an engaging member 230. The engaging member 230 can be moved by the cylinder 226 between a position in which it engages a front surface of a stacked damper 24*a* and a position in which it is spaced from the front surface of the stacked damper 24*a*.

The damper delivery unit 224 has a horizontal cylinder 232 having a rod 234 which extends in the direction D and is coupled to a slide base 236. The slide base 236 is movable back and forth along guide rails 238 in the direction D. A guide rail 240 extending in the direction E is fixed to the slide base 236. A pair of cylinders 242 oriented away from each other is fixedly mounted on the slide base 236. The cylinders 242 have respective rods 244 extending away from each other to which there are coupled respective openable and closable fingers 246 that are guided by guide rail 240. The fingers 246 can hold the foremost stack of dampers 24*a* on the conveyor 220 and move those dampers 24*a* from the conveyor 220 toward the shutter 196.

As shown in FIGS. 9 through 11, a damper inverting and arraying unit 250 is disposed below the shutter 196. The damper inverting and arraying unit 250 comprises a sorter 252 for sorting a damper 24*a* into a desired orientation after the damper 24*a* has dropped when the shutter 196 is opened, and a guide chute 254 for guiding the damper 24*a* from a horizontal attitude into a vertical attitude.

The sorter 252 is coupled to a link 260 mounted on a rod 258 extending from a cylinder 256, and has its upper portion angularly movable about a pivot shaft 262 by the cylinder 256. The sorter 252 serves to invert two dampers 24*a* in different directions, respectively, and position them in a vertical attitude with respective bosses 263 on mounting ends thereof being in confronting relation to each other. A standby station 264 having a buffering function to hold the two dampers 24*a* temporarily in the upstanding attitude is disposed below the sorter 252. The standby station 264 has a pair of support plates 268 movable toward and away from each other by respective cylinders 266 for supporting the two dampers 24*a* in the upstanding attitude on the support plates 268.

Figure 14:
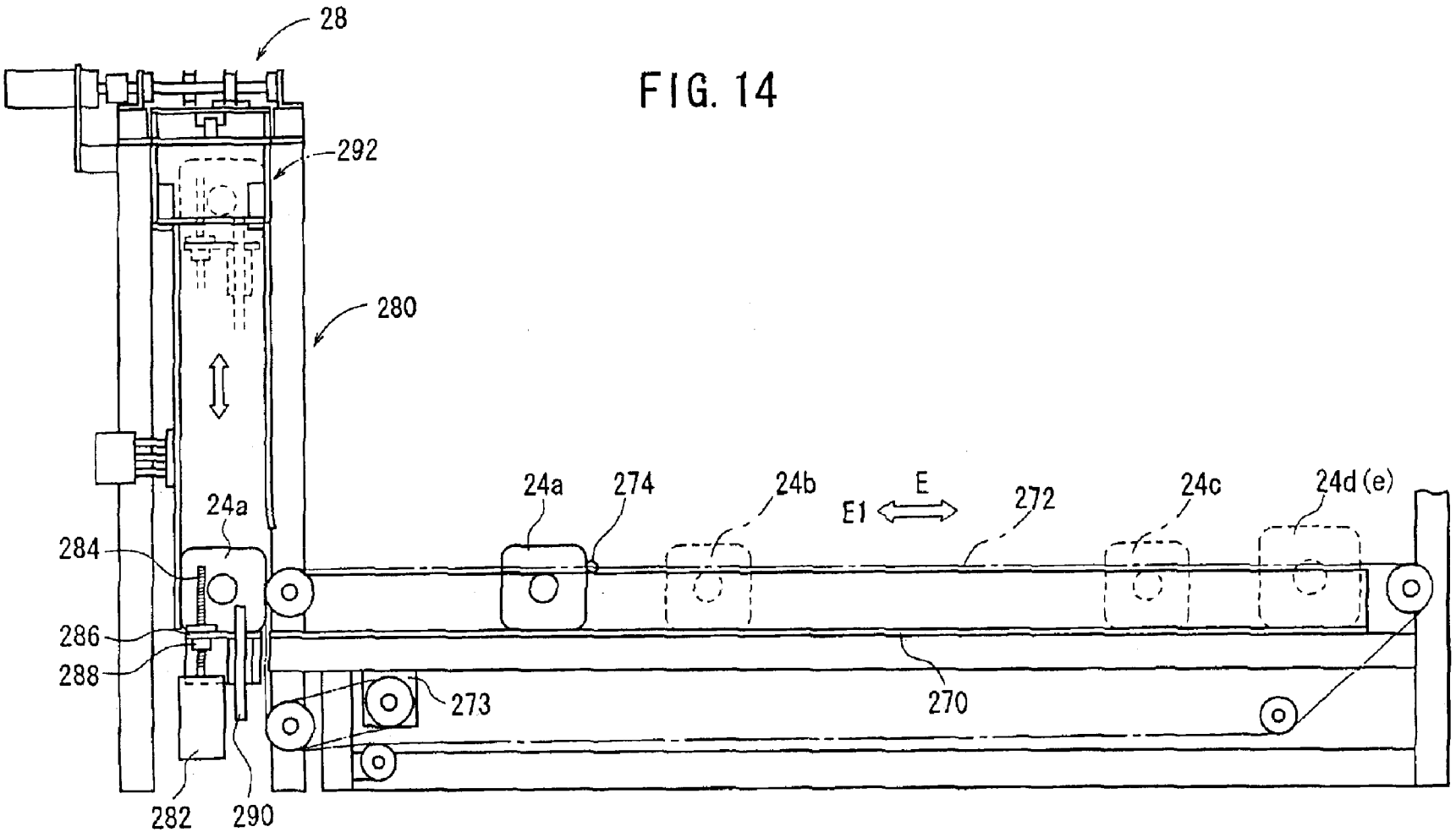
FIG. 14 is a front elevational view of a lifter and a feed base for delivering dampers supplied from the dedicated magazine to a damper transfer station.

A feed base 270 is disposed below the standby station 264 and extends in the direction E. As shown in FIG. 14, a pair of chains 272 is disposed along the feed base 270. The chains 272 are laterally spaced from each other by a distance large enough to hold a set of two dampers 24*a* in the upstanding attitude therebetween. The chains 272 are operatively coupled to a rotary actuator 273, and have pins 274 coupled thereto at given spaced intervals (see FIGS. 9 and 14). Each of the pins 274 can abut against the set of two dampers 24*a* and feed them along the feed base 270 toward a damper delivery side in the direction indicated by the arrow E1.

The dedicated magazine 190*a* is basically constructed as described above. The dedicated magazines 190*b*, 190*c* and the common magazine 192 are identical in structure to the dedicated magazine 190*a*. The parts of the dedicated magazines 190*b*, 190*c* and the common magazine 192 which are identical to those of the dedicated magazine 190*a* are denoted by identical reference characters, and will not be described in detail below.

Figure 15:
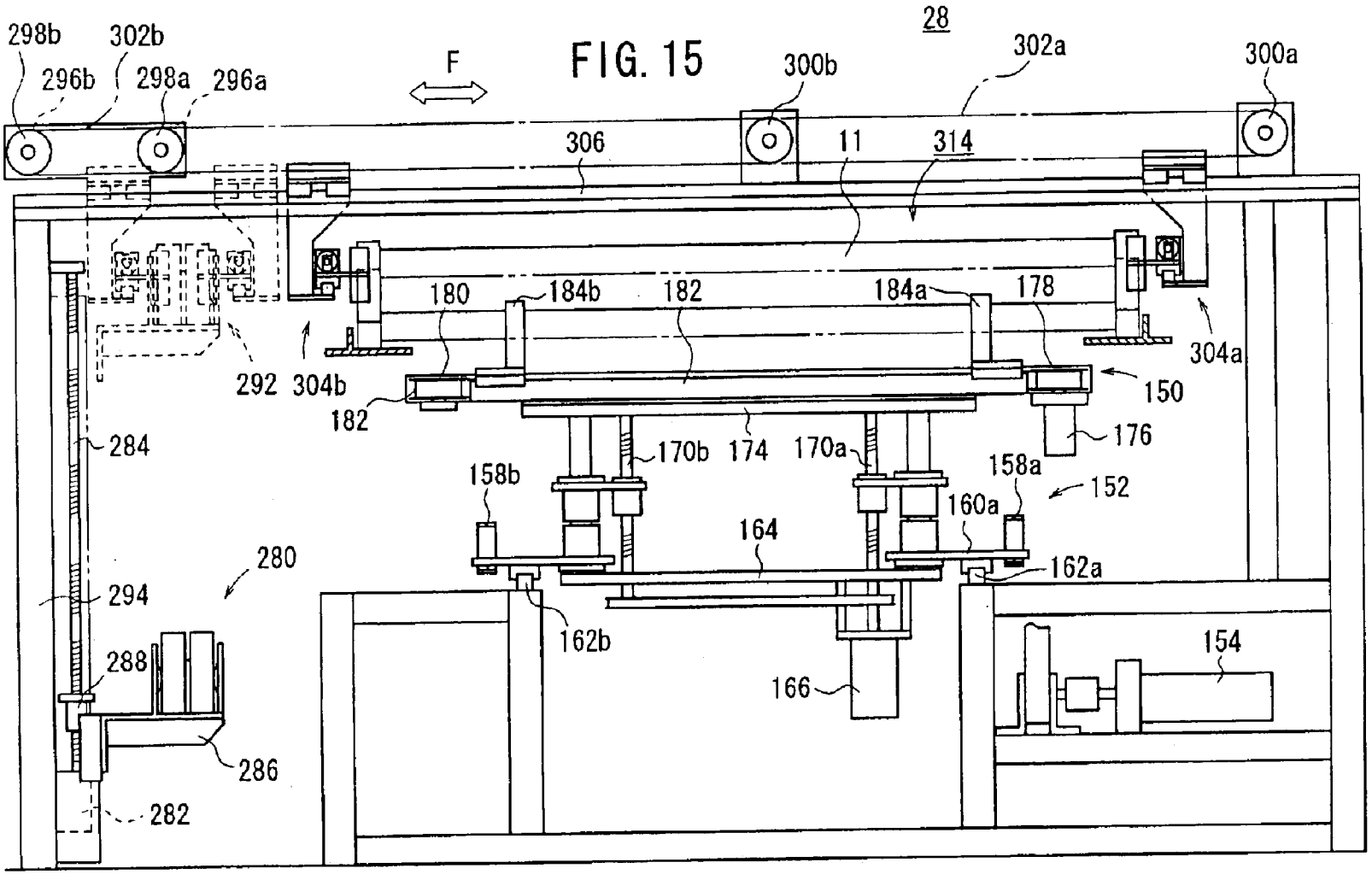
FIG. 15 is a front elevational view of a damper mounting mechanism.

As shown in FIG. 14, a lifter 280 is disposed at the tip end of the feed base 270 in the direction E1. As shown in FIGS. 14 and 15, the lifter 280 has a ball screw 284 coupled to a rotary actuator 282 and extending upwardly. The ball screw 284 is threaded through a nut 288 mounted on a table 286. The table 286 is vertically movable by the ball screw 284 that is rotated by the rotary actuator 282 while being guided by a guide rail 290 which extends parallel to the ball screw 284. When the chains 272 operate in circulatory motion, a set of two dampers 24*a* that have been delivered in the direction E1 by the chains 272 are placed onto the table 286, which then deliver the dampers 24*a* to a damper transfer station 292. The damper mounting mechanism 28 is mounted in the damper transfer station 292.

Figure 16:
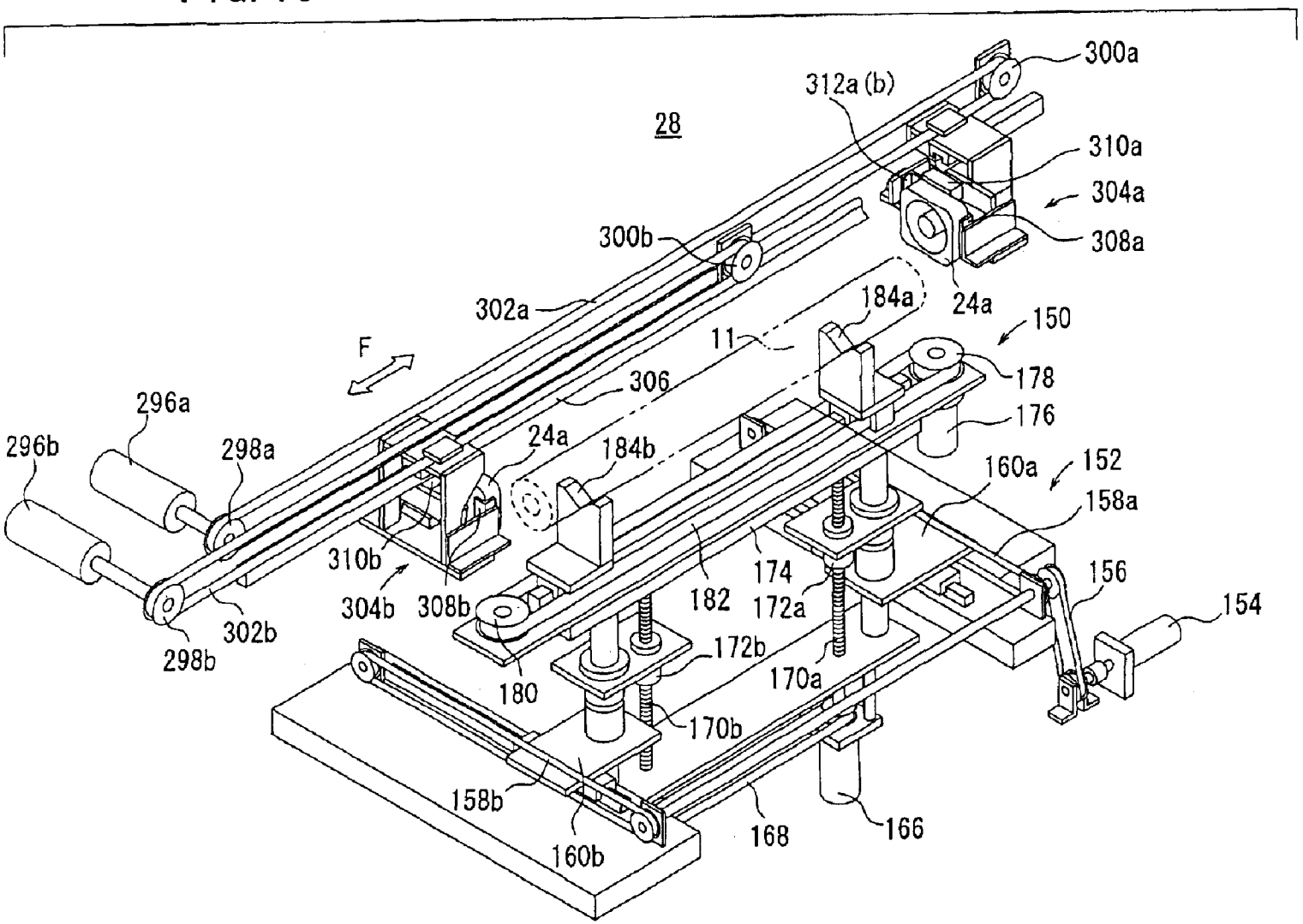
FIG. 16 is a perspective view of the damper mounting mechanism.

As shown in FIGS. 15 and 16, the damper mounting mechanism 28 has two rotary actuators 296*a*, 296*b* horizontally mounted on a framework 294 parallel to each other. Drive pulleys 298*a*, 298*b* are coupled to the respective drive shafts of the rotary actuators 296*a*, 296*b*. Driven pulleys 300*a*, 300*b* are rotatably mounted on the framework 294 and spaced respective distances from the drive pulleys 298*a*, 298*b* in the direction indicated by the arrow F. Belts 302*a*, 302*b* are trained around the drive pulleys 298*a*, 298*b* and the driven pulleys 300*a*, 300*b*. The belts 302*a*, 302*b* extend in the direction F parallel to each other and have respective ends staggered in the direction F.

Clamps 304*a*, 304*b* are coupled to the respective belts 302*a*, 302*b* and supported on a guide rail 306 mounted on an upper frame member of the framework 294 and extending in the direction F. The clamps 304*a*, 304*b* have respective fixed fingers 308*a*, 308*b* for engaging respective sides of dampers 24*a* and movable fingers 312*a*, 312*b* for holding respective other sides of the dampers 24*a*, the movable fingers 312*a*, 312*b* being movable toward and away from the fixed fingers 308*a*, 308*b* by respective cylinders 310*a*, 310*b*.

The damper mounting mechanism 28 is movable back and forth between the damper transfer station 292 and a damper inserting station 314. A light-shielded photosensitive roll 11 can be positioned below the damper inserting station 314 by the product feeder 152, and the third feed mechanism 20 can be positioned below the light-shielded photosensitive roll 11 with the dampers mounted thereon.

Figure 17:
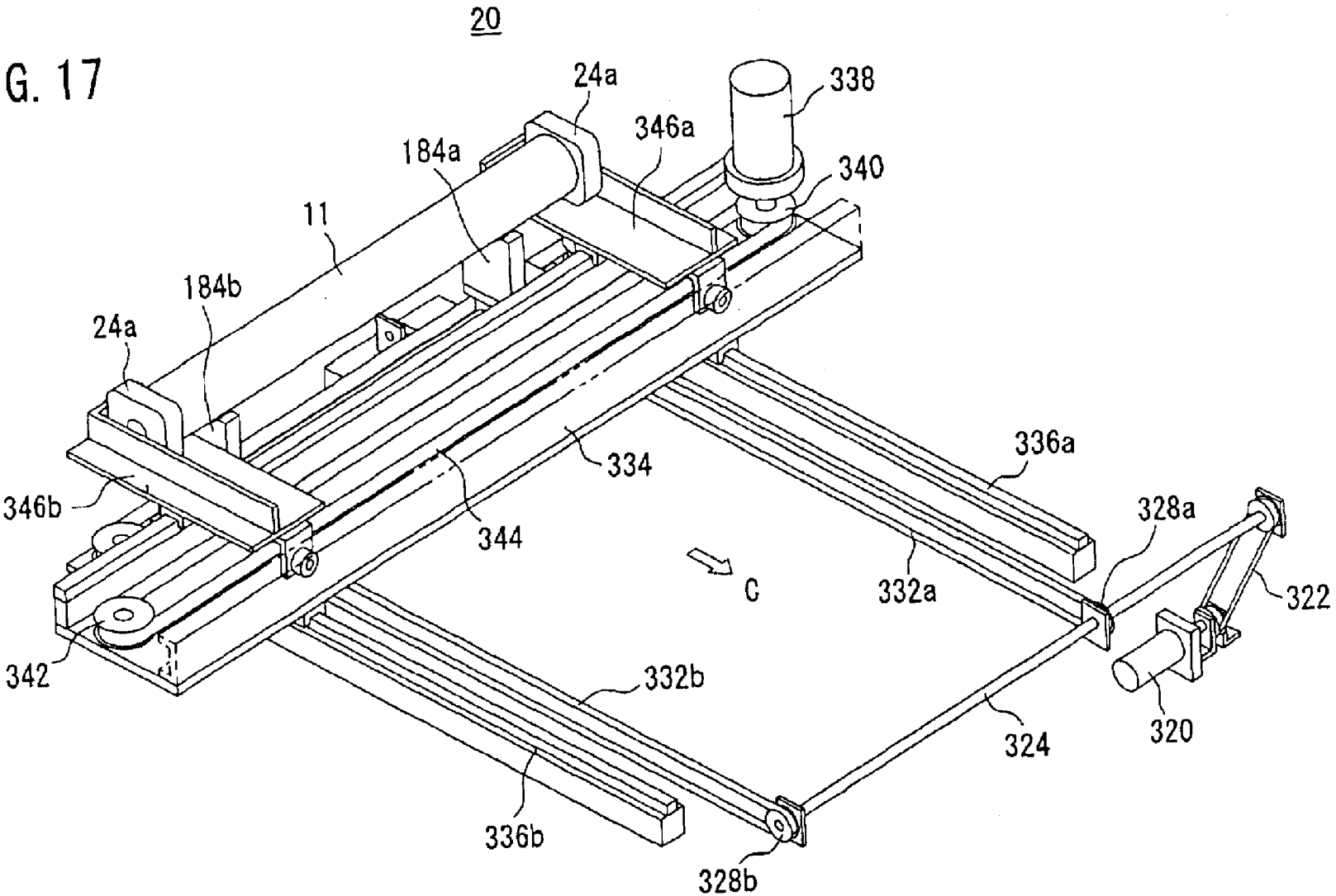
FIG. 17 is a perspective view of the third feed mechanism.
Figure 18:
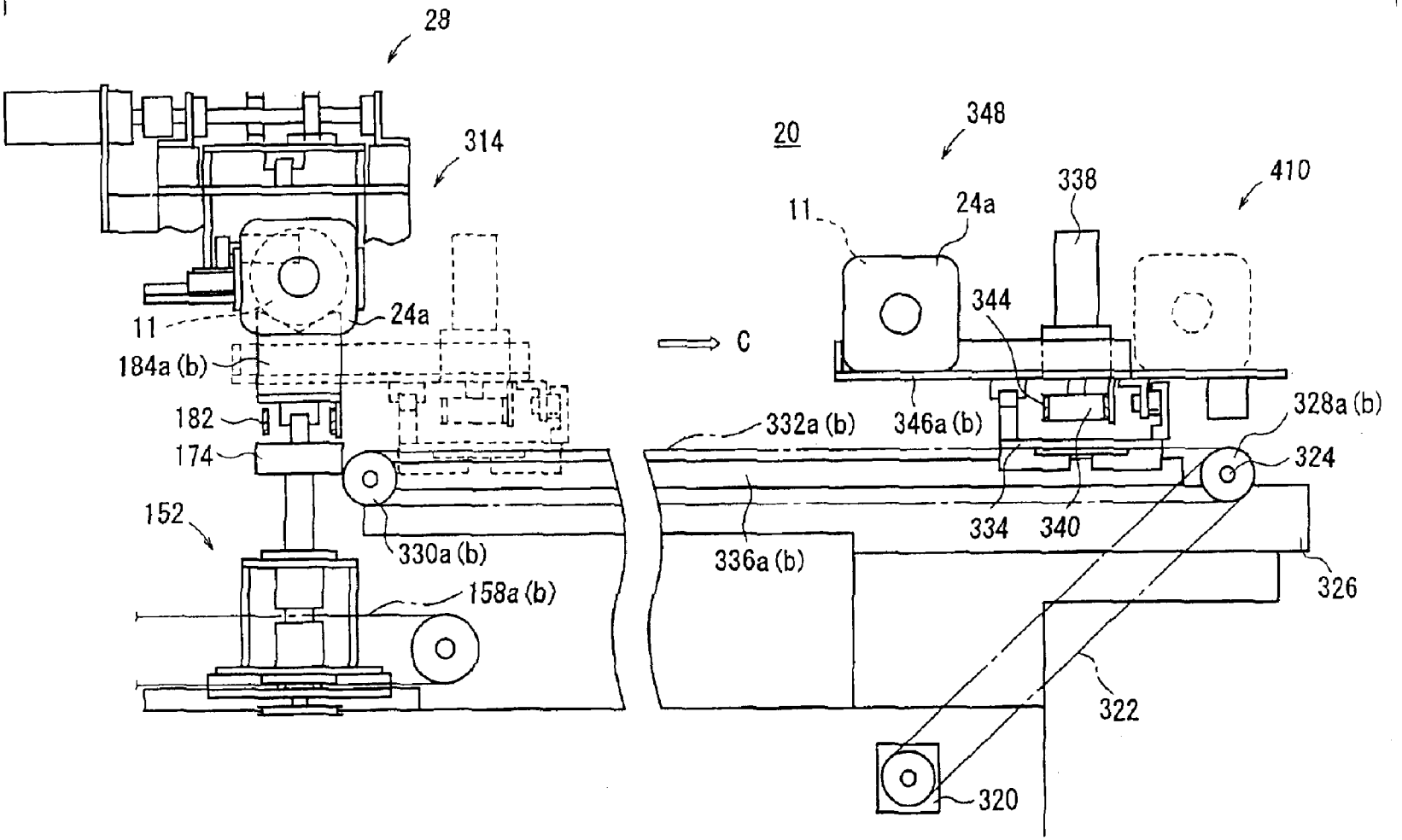
FIG. 18 is a fragmentary side elevational view of the third feed mechanism.

As shown in FIGS. 17 and 18, the third feed mechanism 20 has a rotary actuator 320 operatively coupled to a rotatable shaft 324 by a belt and pulley means 322. The rotatable shaft 324 is rotatably supported on a mount base 326 and supports a pair of pulleys 328*a*, 328*b* mounted thereon which are spaced from each other by a predetermined distance. Pulleys 330*a*, 330*b* are rotatably supported on the mount base 326 and spaced a predetermined distance from the pulleys 328*a*, 328*b* in a direction opposite to the direction C. Belts 332*a*, 332*b* are trained around the pulleys 328*a*, 328*b* and the pulleys 330*a*, 330*b*.

The belts 332*a*, 332*b* are fixed to a movable base 334 which are guided by guide rails 336*a*, 336*b* mounted on the mount base 326. The movable base 334 supports a rotary actuator 338 mounted thereon and has a drive shaft supporting a drive pulley 340 which is operatively coupled to a driven pulley 342 on the movable base 334 by a belt 344 extending in a direction normal to the direction C. The belt 344 has two parallel stretches to which respective rests 346*a*, 346*b* are fixed.

Figure 19:
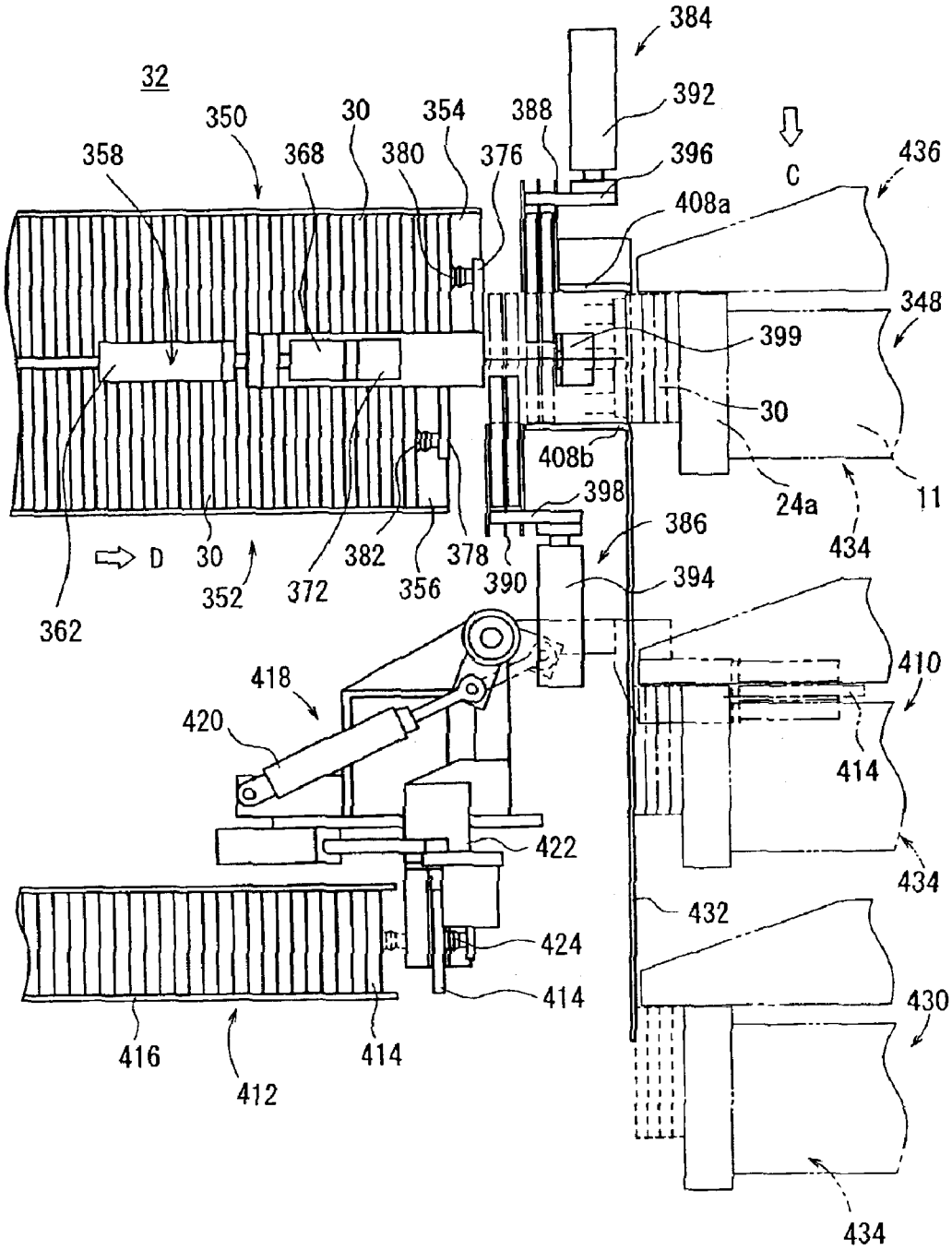
FIG. 19 is a front elevational view of a spacer supply mechanism.

A spacer inserting station 348 is positioned at the tip end of the third feed mechanism 20 in the direction C. The spacer inserting station 348 is supplied with spacers 30 from the spacer supply mechanism 32. As shown in FIG. 19, the spacer supply mechanism 32 has first and second magazines 350, 352 extending parallel to each other in the direction D. The first and second magazines 350, 352 are identical in structure to each other and each accommodate a plurality of spacers 30.

The first magazine 350 has a spacer removal distal end spaced forward in the direction D from the spacer removal distal end of the second magazine 352 by a distance equal to the thickness of a certain number of spacers 30, e.g., two spacers 30. The first and second magazines 350, 352 have respective conveyors 354, 356 for feeding a plurality of spacers 30 in an upstanding attitude in the direction D. A spacer remover 358 is disposed above a substantially intermediate region of the first and second magazines 350, 352.

Figure 20:
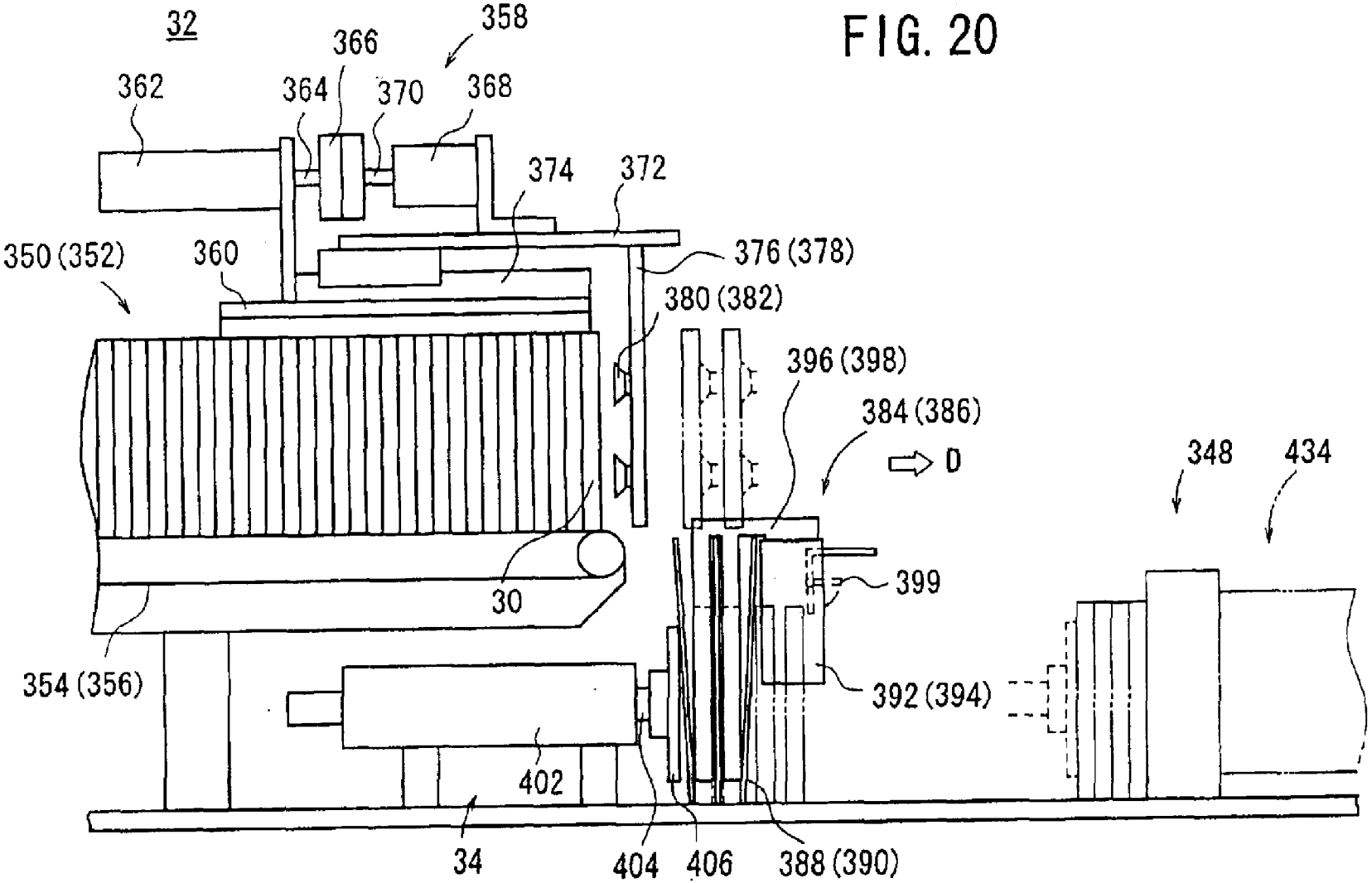
FIG. 20 is a side elevational view of the spacer supply mechanism.

As shown in FIGS. 19 and 20, the spacer remover 358 includes a base 360 disposed above the first and second magazines 350, 352 and supporting thereon a first cylinder 362 extending in the direction D. The first cylinder 362 has a projecting rod 364 connected to a projecting rod 370 of a second cylinder 368 by a coupling 366. The second cylinder 368 is fixed to a slide base 372 movably mounted on the base 360 by a linear guide 374.

First and second attachment plates 376, 378 which extend downwardly and parallel to each other in the direction C are fixedly mounted on the slide base 372. Two vertically spaced first suction pads 380 and two vertically spaced second suction pads 382 are mounted respectively on the first and second attachment plates 376, 378.

First and second spacer arraying units 384, 386 are disposed at the tip ends of the first and second magazines 350, 352 in the direction D. The first and second spacer arraying units 384, 386 have respective sets of arraying guide plates 388, 390 for dropping and arraying two spacers 30 removed from each of the first and second magazines 350, 352 by the spacer remover 358, respective presser plates 396, 398 displaceable toward and away from each other in the direction C by respective cylinders 392, 394 for displacing the spacers 30 dropped and arrayed by the arraying guide plates 388, 390 toward each other, and a swing stopper 399 for engaging the arrayed four spacers 30 to prevent them from falling down. The presser plates 396, 398 are of a comb-toothed structure, for example, to keep themselves out of interference with the arraying guide plates 388, 390.

The spacer inserting mechanism 34 is disposed behind the spacers 30 which have been arrayed by the first and second spacer arraying units 384, 386. The spacer inserting mechanism 34 has a pressing cylinder 402 extending in the direction D and has a projecting rod 404 to which an insertion plate 406 is fixed. Guide plates 408*a*, 408*b* (see FIG. 19) are provided for guiding spacers 30 to the damper 24*a*, 24*b*, 24*c*, 24*d*, or 24*e* (hereinafter referred to as the damper 24*a*) mounted on one end of a light-shielded photosensitive roll 11 when the spacers 30 are displaced by the spacer inserting mechanism 34.

An inner sheet inserting station 410 is disposed downstream of the spacer inserting station 348 in the direction C. The inner sheet inserting station 410 is supplied with an inner sheet 414 by an inner sheet supply mechanism 412. In the inner sheet supply mechanism 412, inner sheets 414 are successively fed in the direction D by a conveyor 416 and removed one at a time by an inner sheet remover 418. The inner sheet remover 418 has a swing arm 422 swingable by a cylinder 420 and supporting on its distal end two vertically spaced suction pads 424.

A box assembling station 430 is disposed downstream of the inner sheet inserting station 410 in the direction C. A spacer keeper guide 432 for preventing spacers 30 from falling down extends from the spacer inserting station 348 to the box assembling station 430. An inner roll assembly 434 which comprises a light-shielded photosensitive roll 11 with a certain number of spacers 30 inserted on one damper 24*a* mounted thereon is fed by a roll feed mechanism 436 to the spacer inserting station 348, the inner sheet inserting station 410, and the box assembling station 430.

Figure 21:
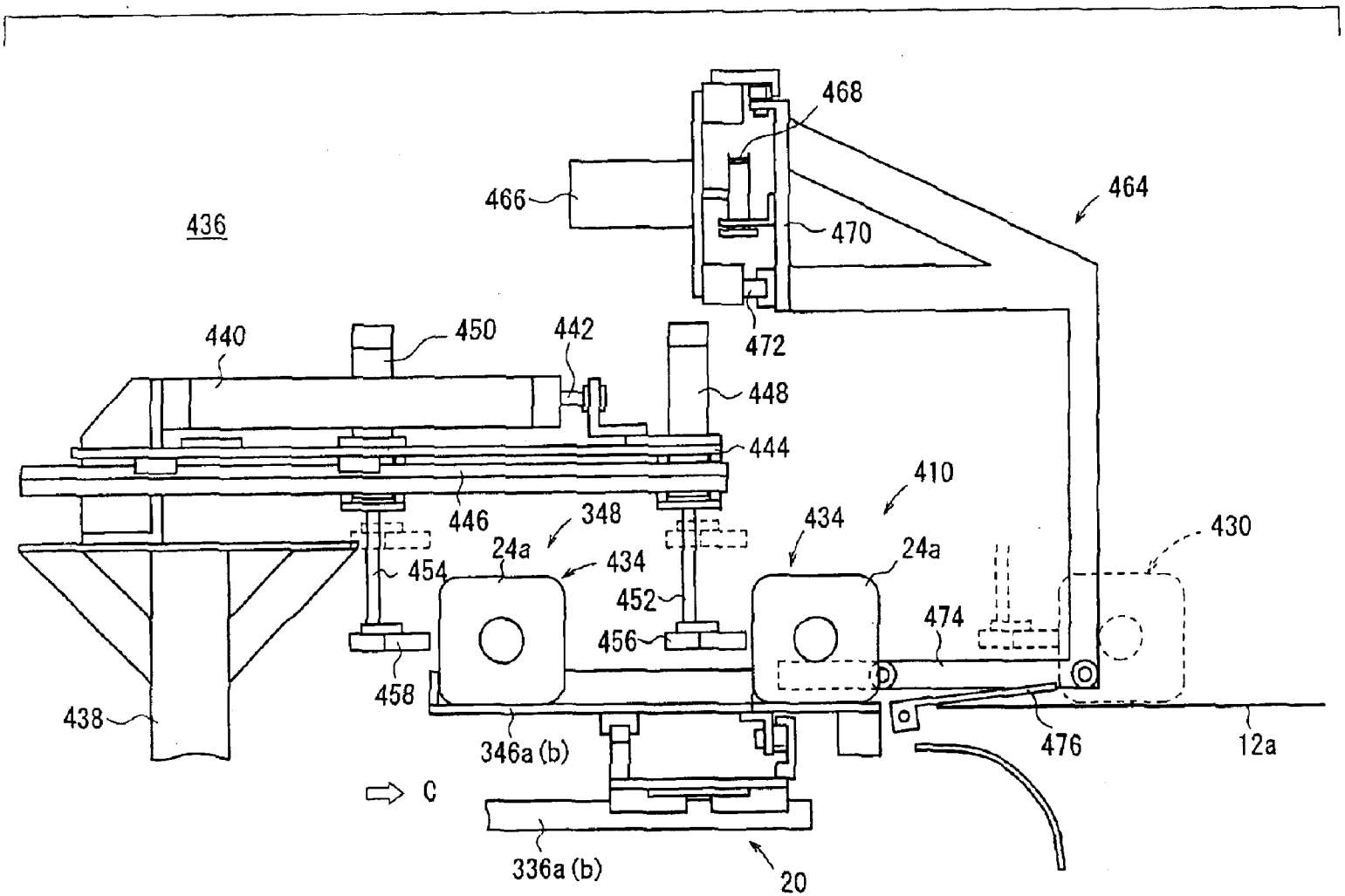
FIG. 21 is a side elevational view of a roll feed mechanism.
Figure 22:
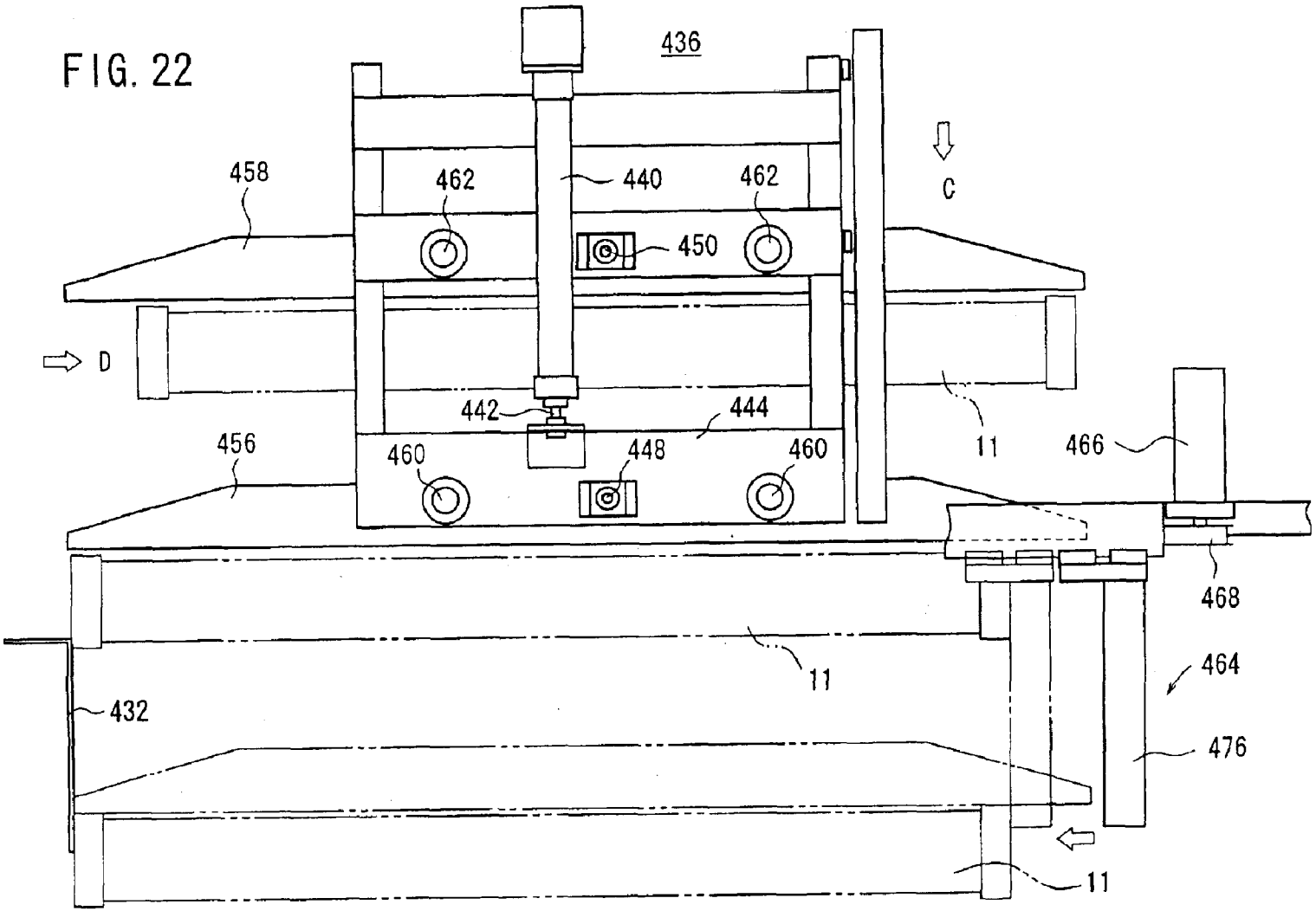
FIG. 22 is a plan view of the roll feed mechanism.

As shown in FIGS. 21 and 22, the roll feed mechanism 436 has a cylinder 440 mounted on a support column 438 and having a rod 442 which extends in the direction C and is fixed to a slide base 444. The slide base 444 is guided by a linear guide 444 for movement back and forth in the direction C.

Figure 23:
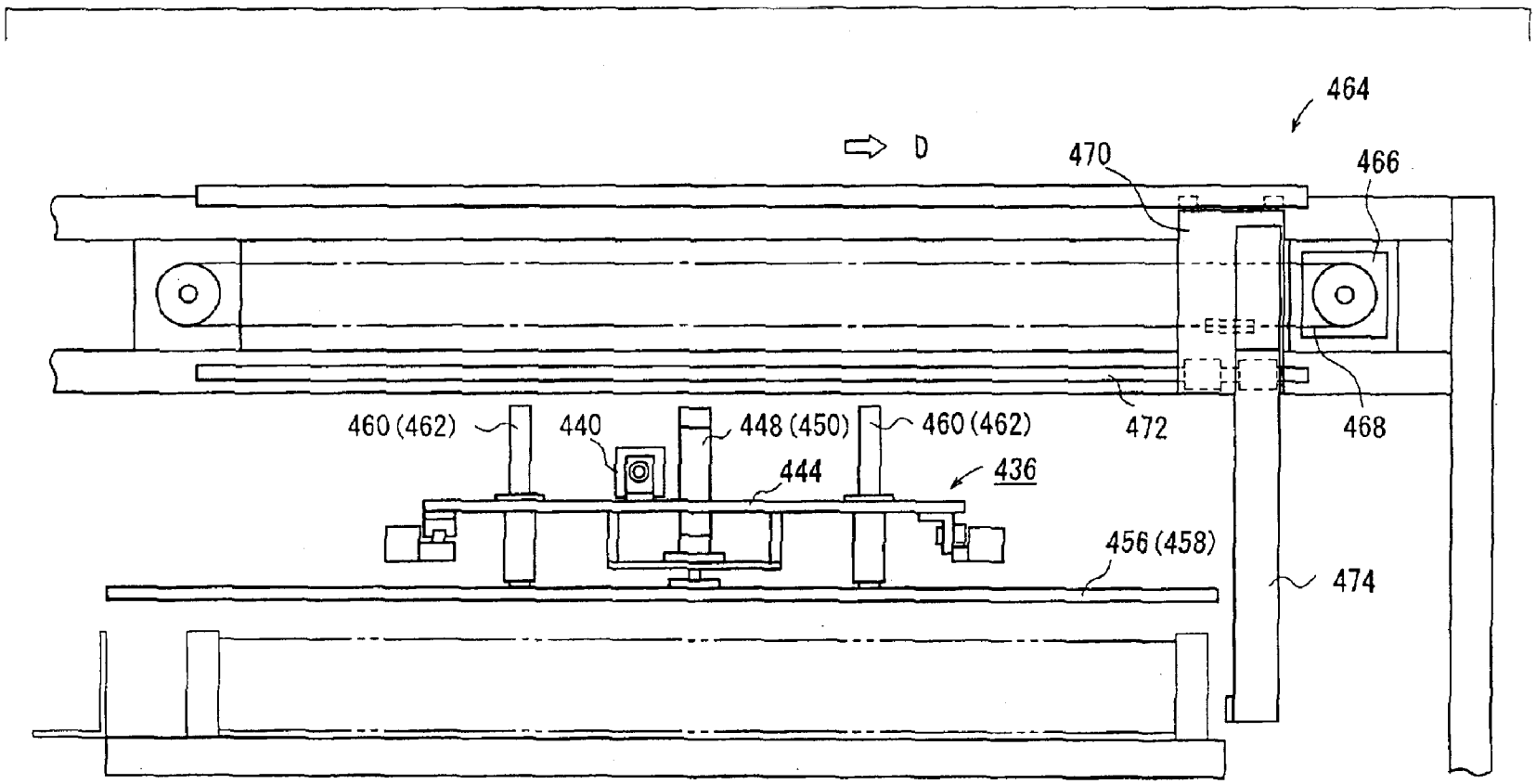
FIG. 23 is a front elevational view of the roll feed mechanism.

As shown in FIGS. 21 through 23, lifting/lowering cylinders 448, 450 spaced a predetermined distance from each other in the direction C are oriented downwardly and fixedly mounted on the slide base 444. The lifting/lowering cylinders 448, 450 have respective downwardly extending rods 452, 454 with respective plates 456, 458 secured to lower ends thereof. Each of the plates 456, 458 is supported on the slide base 444 by two guide rods 460, 462. As shown in FIGS. 22 and 23, the plates 456, 458 are elongate in the direction D over a distance corresponding to the longitudinal dimension of the elongate inner roll assembly 434.

A positioning unit 464 is positioned in and across the inner sheet inserting station 410 and the box assembling station 430. The positioning unit 464 has a belt and pulley means 468 coupled to a rotary actuator 466 and a movable base 470 fixed to the belt and pulley means 468. The movable base 470 is movable back and forth in the direction D on and along a guide rail 472. A pressing arm 474 bent downwardly and extending horizontally for pressing the end of the inner roll assembly 434 remote from the spacers 30 is mounted on a distal end of the movable base 470.

As shown in FIG. 21, the box assembling station 430 has an engaging plate 476 for limiting the distal end of a corrugated cardboard box 12*a* or 12*b* and positioning the inner roll assembly 434 above the corrugated cardboard box 12*a* or 12*b*.

As shown in FIG. 1, the packaging member supply mechanism 36 has a single second feed line 478 for feeding corrugated cardboard boxes 12*a*, 12*b* of different dimensions as they are unfolded to the box assembling station 430.

Figure 24:
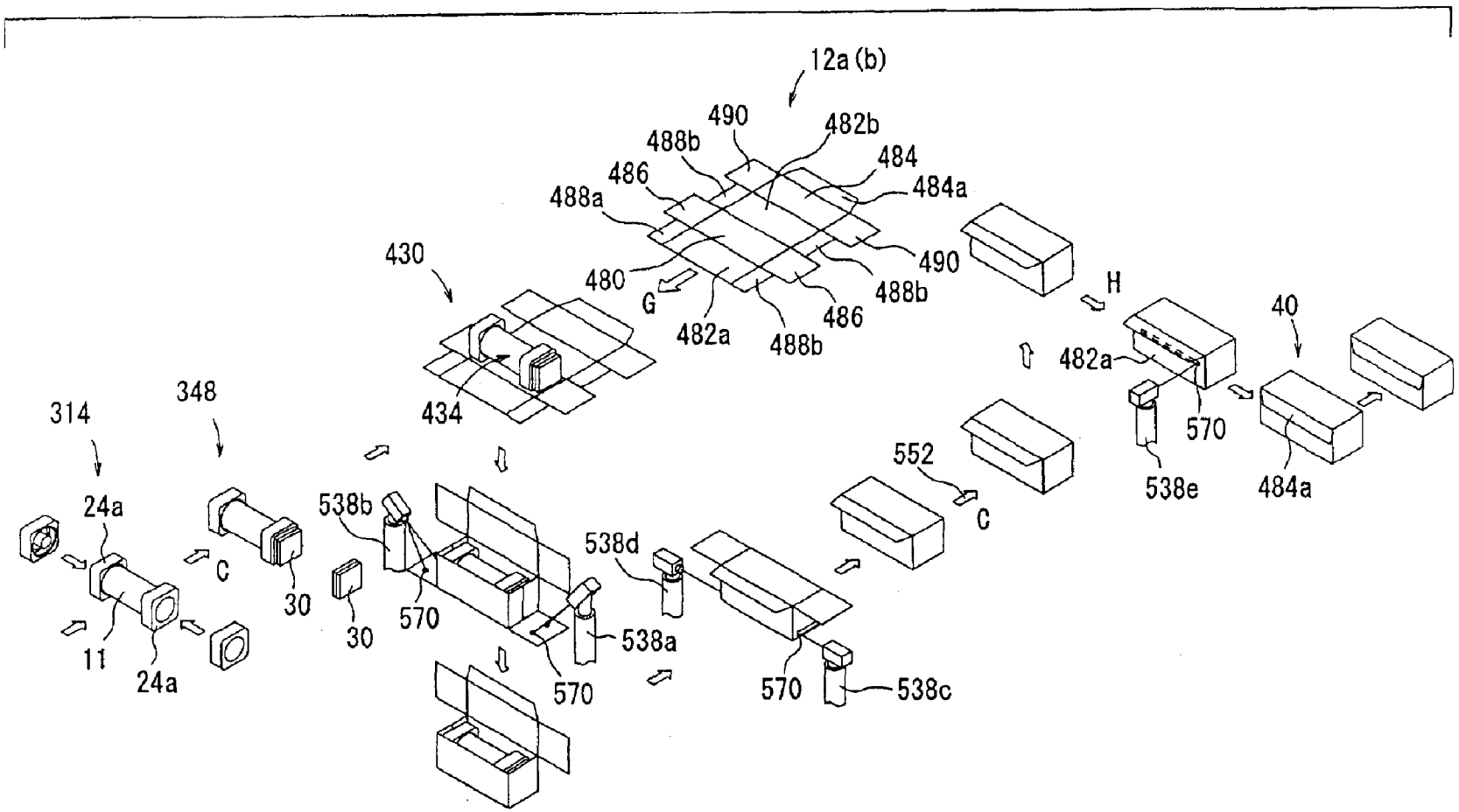
FIG. 24 is a schematic perspective view illustrative of steps of operation from a damper inserting station to a box assembling station.
Figure 25:
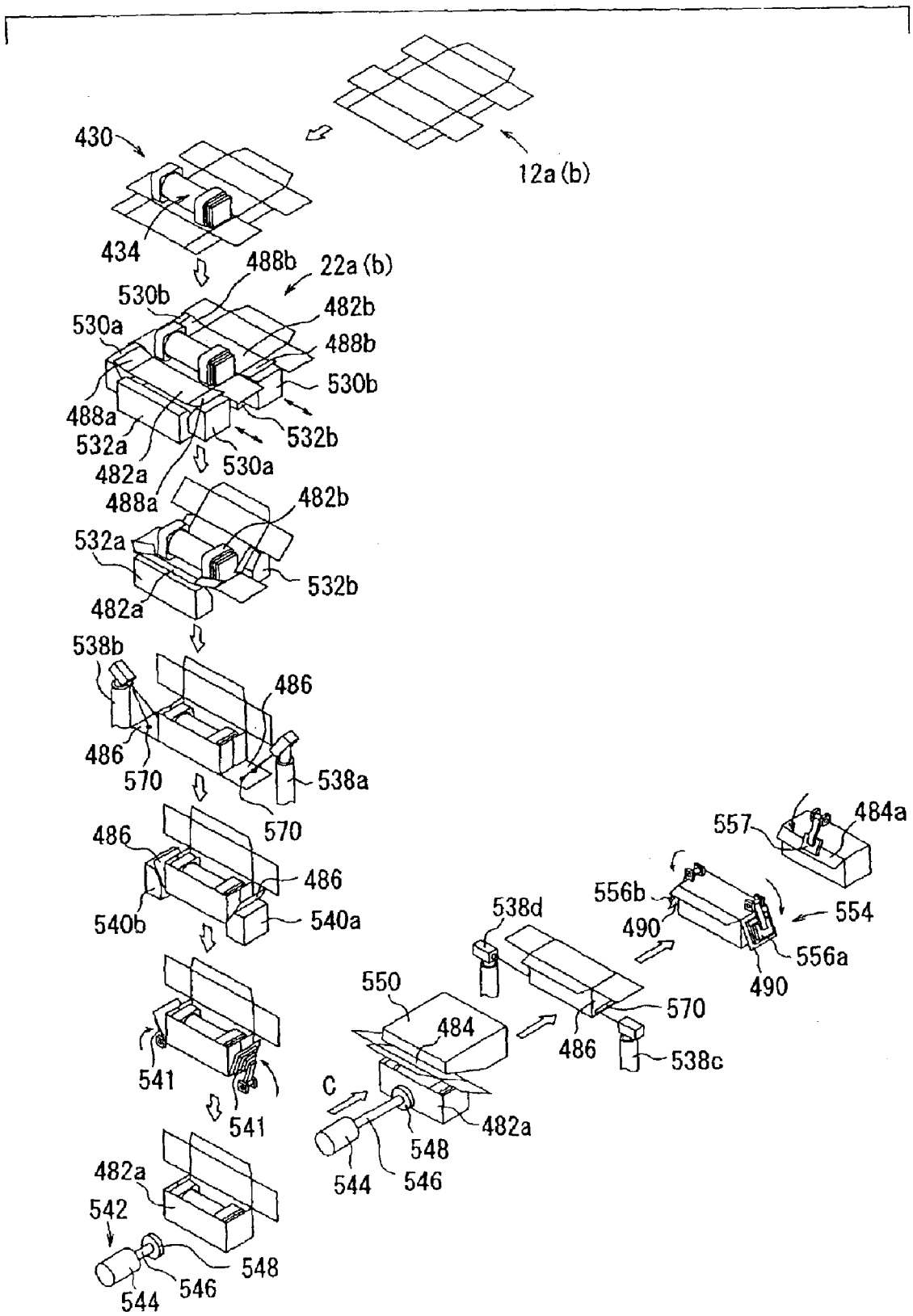
FIG. 25 is a schematic perspective view illustrative of detailed steps of operation in the box assembling station.

FIG. 24 schematically shows steps of operation in the damper inserting station 314, the spacer inserting station 348, the inner sheet inserting station 410, and the box assembling station 430. FIG. 25 schematically shows detailed steps of operation in the box assembling station 430.

Corrugated cardboard boxes 12*a*, 12*b* are supplied as they are unfolded. Each of the corrugated cardboard boxes 12*a*, 12*b* has a bottom panel 480, barrel panels 482*a*, 482*b* joined to both side edges of the bottom panel 480, and a top panel 484 and a top panel fold flap 484*a* which are joined to a side edge of the barrel panel 482*b*. Lower flaps 486 are joined to respective opposite ends of the bottom panel 480. Inner flaps 488*a*, 488*b* are joined to respective opposite ends of each of the barrel panels 482*a*, 482*b*. Upper flaps 490 are joined to respective opposite ends of the top panel 484.

Figure 26:
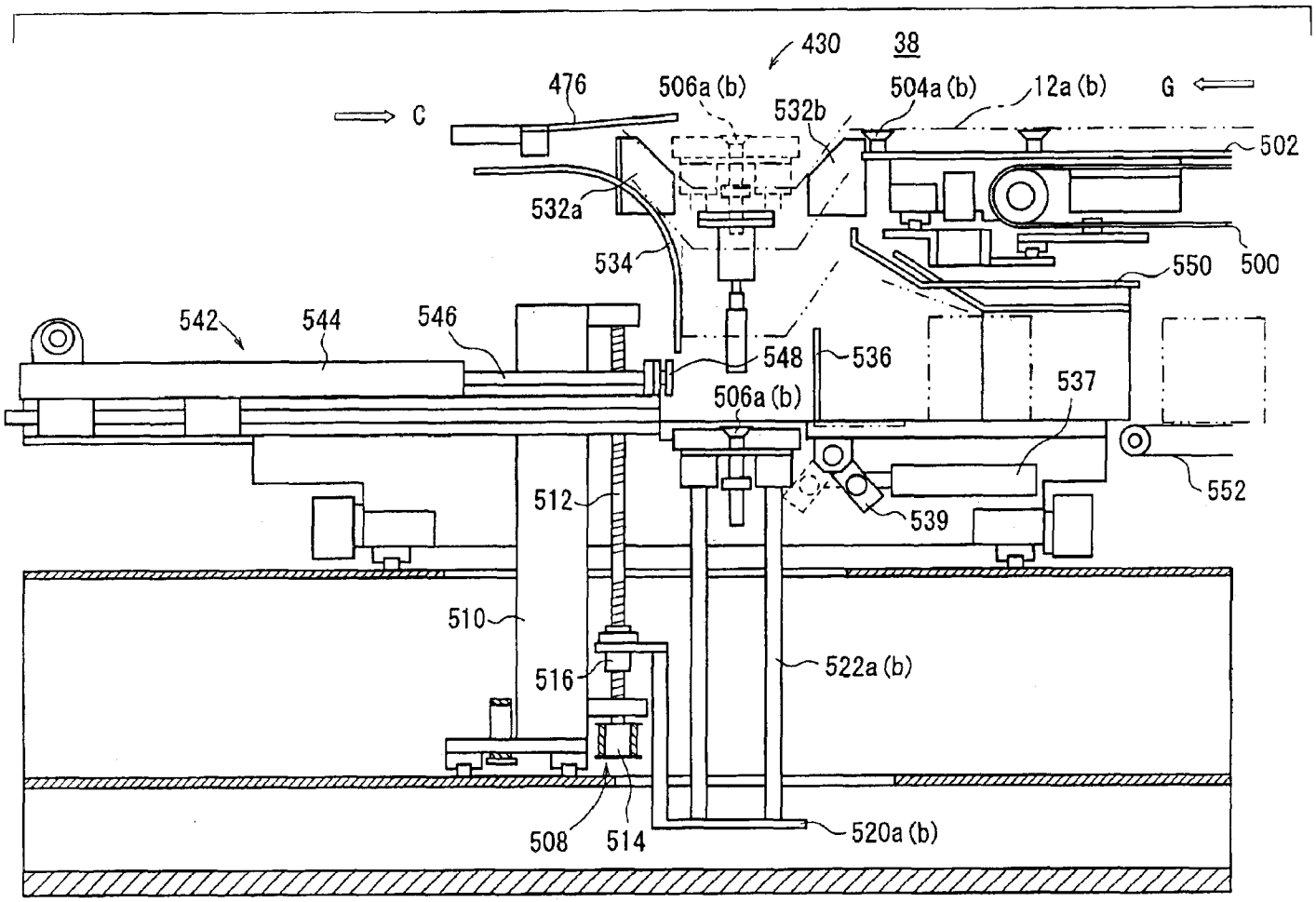
FIG. 26 is a side elevational view, partly in cross section, of a box assembling mechanism.

As shown in FIG. 26, the second feed line 478 has a pair of laterally spaced feed belts 500 extending in the direction G. A pair of suction pads 504*a*, 504*b* is mounted on each of the feed belts 500 by an attachment plate 502. The suction pads 504*a*, 504*b* feed a corrugated cardboard box 12*a* or 12*b* as it is unfolded to the box assembling station 430.

In the box assembling station 430, the box assembling mechanism 38 has withdrawing suction pads 506*a*, 506*b* which are vertically movable by an actuator 508. The actuator 508 has a vertical ball screw 512 rotatably supported on and extending along a movable base 510. The ball screw 512 has a lower end operatively coupled to a rotary actuator (not shown) by a belt and pulley means 514. The ball screw 512 is threaded through a nut 516 that is vertically movable with respect to the movable base 510.

To the nut 516, there are connected vertically movable plates 520*a*, 520*b* with the withdrawing suction pads 506*a*, 506*b* mounted thereon. The vertically movable plates 520*a*, 520*b* are vertically supported by guide bars 522*a*, 522*b*. The movable base 510 is movable in the direction indicated by the arrow F and is positioned in a location depending on the dimensions of the corrugated cardboard box 12*a* or 12*b*.

As shown in FIG. 25, a pair of inner flap folding guides 530*a* and a pair of inner flap folding guides 530*b* for folding the inner flaps 488*a*, 488*b* of the corrugated cardboard box 12*a* or 12*b* through about 90° are disposed near an upper end of the box assembling station 430, either one of the pairs of inner flap folding guides 530*a*, 530*b* being positionally adjustable depending on the dimensions of the corrugated cardboard box 12*a* or 12*b*. Barrel folding guides 532*a*, 532*b* for folding the barrel panels 482*a*, 482*b* through about 90° are disposed across the pairs of inner flap folding guides 530*a*, 530*b*.

As shown in FIG. 26, a fixed-guide plate 534 and a movable guide plate 536 are disposed below the barrel folding guides 532*a*, 532*b*. The movable guide plate 536 is angularly movable from a vertical attitude to a horizontal attitude by a link 539 connected to a cylinder 537.

As shown in FIG. 25, hot-melt adhesive applicators 538*a*, 538*b* for applying a hot-melt adhesive to the inner surface of the lower flaps 486 are disposed below the inner flap folding guides 530*a*, 530*b*. Lower flap folding guides 540*a*, 540*b* for folding the lower flaps 486 through about 90° are disposed beneath the hot-melt adhesive applicators 538*a*, 538*b*. Lower flap folders 541 for bonding the lower flaps 486 to the inner flaps 488*a*, 488*b* are swingably disposed below the lower flap folding guides 540*a*, 540*b*.

As shown in FIGS. 25 and 26, a pusher 542 is disposed in alignment with the lower end of the stroke by which the corrugated cardboard box 12*a* or 12*b* is lowered. The pusher 542 has a pressing cylinder 544 having a rod 546 extending in the direction C and a pressing plate 548 fixed to the distal end of the rod 546. A top panel folding guide 550 for folding the top panel 484 from a vertical position into a horizontal position is disposed at the far end of the stroke by which the rod 546 is extended from the cylinder 544. A belt conveyor 552 is disposed near the distal end of the top panel folding guide 550 in the direction C. The corrugated cardboard box 12*a* or 12*b* after its top panel is folded is fed in the direction C by the belt conveyor 552.

As shown in FIG. 25, hot-melt adhesive applicators 538*c*, 538*d* for applying a hot-melt adhesive to the outer surface of the lower flaps 486 are disposed downstream of the top panel folding guide 550. An upper flap folder 554 is disposed downstream of the hot-melt adhesive applicators 538*c*, 538*d*. The upper flap folder 554 has upper flap folding guides 556*a*, 556*b* that are angularly movable by an actuator (not shown) for folding the upper flaps 490 toward the lower flaps 486 through about 90°. A folding guide 557 for folding the top panel fold flap 484*a* of the top panel 484 is disposed downstream of the upper flap folder 554. The folding guide 557 is angularly movable by an actuator (not shown).

As shown in FIG. 24, the corrugated cardboard box 12*a* or 12*b* that has been brought to the terminal end of the belt conveyor 552 is fed upwardly and then fed horizontally in the direction indicated by the arrow H. A hot-melt adhesive applicator 538*e* for applying a hot-melt adhesive to the barrel panel 482*a* is disposed to bond the top panel fold flap 484*a* to the barrel panel 482*a* while the corrugated cardboard box 12*a* or 12*b* is being fed horizontally in the direction H. The top panel fold flap 484*a* is folded by a folder (not shown) into bonded contact with the barrel panel 482*a*, thus completing a packaged product 40.

Operation of the automatic packaging system 10 thus constructed will be described below.

In the automatic packaging system 10, based on the tracking data of a light-shielded photosensitive roll 11, bar-code information of the light-shielded photosensitive roll 11 is read. Based on the bar-code information thus read, the number of spacers 30 to be inserted is automatically determined, a corrugated cardboard box 12*a* or 12*b* is automatically selected, and a facility changeover is automatically carried out. In the label applying mechanism 44, various items of product information are automatically printed on the bar-code label 42 based on the tracking data, producing an identification number (ID). The database of label data is shifted from a personal computer associated with the automatic packaging system 10 to a host computer. When the host computer applies operation commands, it also applies label data matching the operation commands, and automatically sets the operation commands and the label data in a facility sequence.

As shown in FIG. 4, a light-shielded photosensitive roll 11 which has been manufactured in the preceding process and placed on a pallet 74 is fed in the direction A by the upper feed conveyor 70 of the first feed mechanism 14, and brought into alignment with the lifter 76. Then, the inspection mechanism 16 is fed by the second feed mechanism 18 to a position in alignment with the light-shielded photosensitive roll 11 on the lifter 76.

In the second feed mechanism 18, as shown in FIG. 5, when the first ball screw 108 is rotated by the rotary actuator 106, the belt and pulley means 110 causes the second ball screw 112 to rotate in unison with the first ball screw 108. On rotation of the first and second ball screws 108, 112, the nuts 116*a*, 116*b* lower the vertically movable frame 114 to place the light-shielded photosensitive roll 11 on the pallet 74 between the first and second clamps 138, 140. At this time, the bar-code reader 128 mounted on the vertically movable frame 114 of the inspection mechanism 16 reads the bar code 66 that is applied to the outer circumferential surface of the light-shielded photosensitive roll 11.

In the inspection mechanism 16, the rotary actuator 130 is energized to circulatingly move the belt 136 trained around the drive pulley 132 and the driven pulley 134. The first and second clamps 138, 140 fixed to the respective two stretches of the belt 136 are moved toward each other until they grip the opposite ends of the light-shielded photosensitive roll 11.

The distances that the magnescales 144 mounted respectively on the first and second clamps 138, 140 have moved ate read into a sequencer (not shown), and the axial length of the light-shielded photosensitive roll 11 is calculated from the read distances.

As shown in FIG. 7, the diameter measuring unit 126 is mounted on the first clamp 138 and/or the second clamp 140. If a hard flange is fitted in an end of the light-shielded photosensitive roll 11, then the light-emitting element 146*a* and the light-detecting element 146*b* detect an end of the hard flange. When the first and second clamps 138, 140 are lowered, the other light-shielding flanged member 56 is irradiated with detecting light emitted from the light-emitting/detecting sensor 148. Entered and block light is detected by the light-emitting/detecting sensor 148 and read into a counter in the sequencer, which processes the light signals to measure the inside and outside diameters of the light-shielded photosensitive roll 11.

The measured results from the diameter measuring unit 126 and the magnescales 144 are compared with the bar-code information read from the bar code to inspect whether the light-shielded photosensitive roll 11 is correct or wrong. If the light-shielded photosensitive roll 11 is judged as being wrong, then the link mechanism 88 of the rejecting mechanism 78 is actuated (see FIG. 4). The arms 84*a*, 84*b*, 84*c* are angularly moved upwardly about the pivot shaft 82 to lift the light-shielded photosensitive roll 11 off the pallet 74 and discharge the light-shielded photosensitive roll 11 into the stack tray 90.

If the light-shielded photosensitive roll 11 is judged as being correct, then the rotary actuator 106 of the second feed mechanism 18 is energized while the opposite ends of the light-shielded photosensitive roll 11 are being gripped by the inspection mechanism 16 (see FIGS. 5 and 6). The first and second ball screws 108, 112 are rotated to elevate the vertically movable frame 114 to remove the light-shielded photosensitive roll 11 gripped by the first and second clamps 138, 140 upwardly from the pallet 74. In the second feed mechanism 18, the rotary actuator 94 is energized to move the belt 100 trained around the drive pulley 96 and the driven pulley 98, moving the movable base 102 in the direction B to feed the light-shielded photosensitive roll 11 to a position above the product charger 150.

In the product charger 150, as shown in FIGS. 6 and 8, the distance between the rests 184*a*, 184*b* has been adjusted depending on the axial length of the light-shielded photosensitive roll 11. Specifically, the rotary actuator 176 is energized to cause the belt 182 trained around the drive pulley 178 and the driven pulley 180 to displace the rests 184*a*, 184*b* toward or away from each other until the rests 184*a*, 184*b* are positioned depending on the axial length of the light-shielded photosensitive roll 11.

Then, the rotary actuator 106 is energized to lower the vertically movable frame 114 to place the light-shielded photosensitive roll 11 held on the vertically movable frame 114 by the first and second clamps 138, 140 onto the rests 184*a*, 184*b* of the product charger 150. The rotary actuator 130 is energized to displace the first and second clamps 138, 140 away from each other, releasing the light-shielded photosensitive roll 11, which is then placed on the rests 184*a*, 184*b* only.

The height of the rests 184*a*, 184*b* has been adjusted depending on the diameter of the light-shielded photosensitive roll 11. Specifically, the rotary actuator 166 is energized to rotate the third and fourth ball screws 170*a*, 170*b*, bringing the vertically movable base 174 into a predetermined vertical position. The vertically movable base 174 is thus vertically positioned because a damper inserting process, to be described later on, will be carried out at a fixed height with respect to the position of lower surfaces of dampers 24*a*.

After the light-shielded photosensitive roll 11 has been placed on the rests 184*a*, 184*b*, the rotary actuator 154 of the product feeder 152 is energized. The belts 158*a*, 158*b* are moved circulatingly by the rotary actuator 154 to feed the light-shielded photosensitive roll 11 on the rests 184*a*, 184*b* in unison with the movable bases 160*a*, 160*b* in the direction C until the light-shielded photosensitive roll 11 is placed in the damper inserting station 314.

Based on the bar-code information read from the bar code on the light-shielded photosensitive roll 11 by the inspection mechanism 16, a type of dampers to be supplied from the damper supply mechanism 26 is determined to select dampers 24*a*, for example. A number of spacers 30 accommodated in the spacer supply mechanism 32 is also determined, and a type of a packaging member to be supplied from the packaging member supply mechanism 36, e.g., a corrugated cardboard box 12*a*, is selected.

Figure 27:
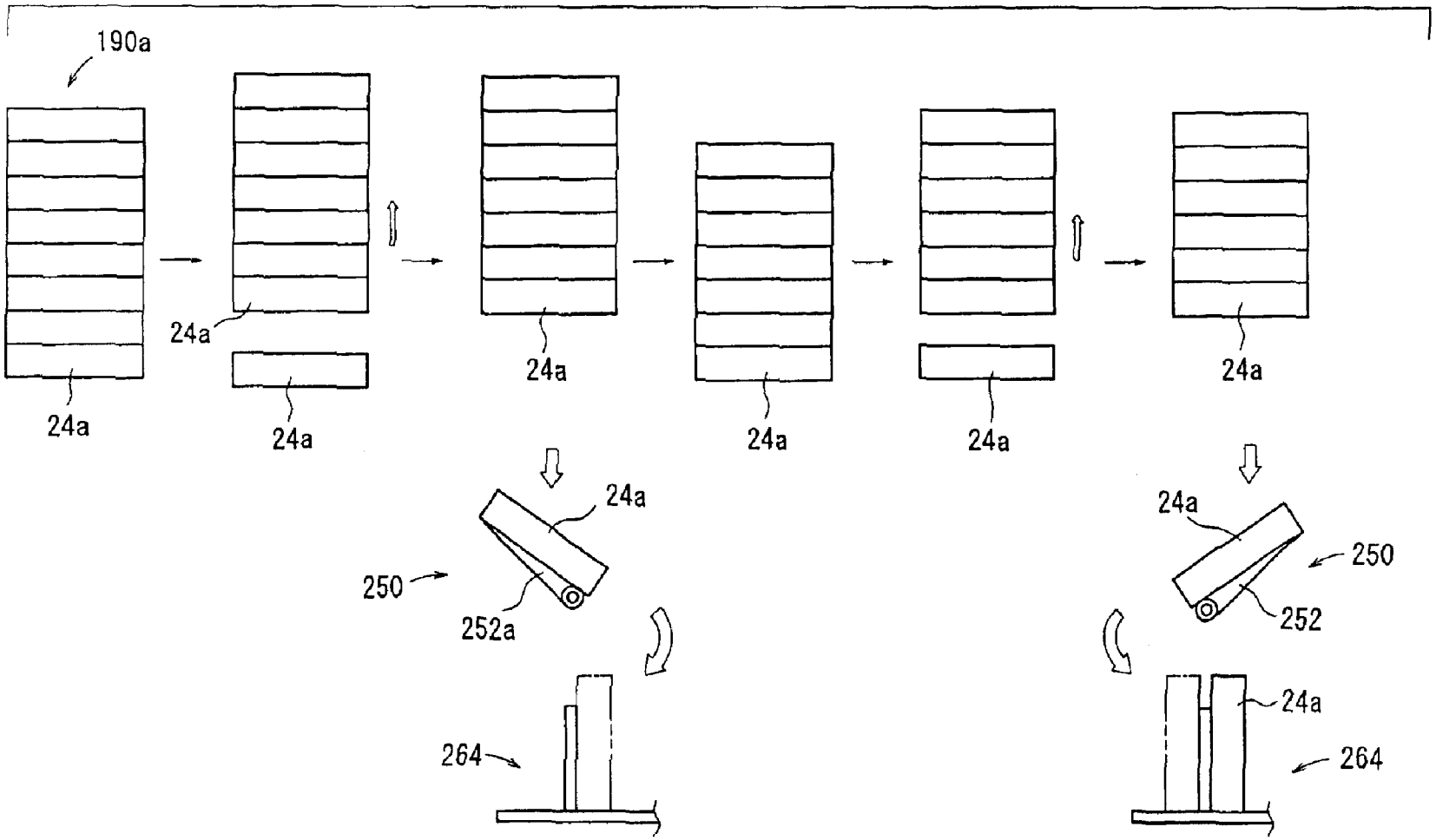
FIG. 27 is a side elevational view illustrative of the manner in which a damper inverting and arraying unit operates.

In the damper supply mechanism 26, as shown in FIGS. 9 through 11, the stack of dampers 24*a* which is positioned at the foremost end of the horizontal array in the dedicated magazine 190*a* includes the lowermost damper 24*a* held by the angles 204 of the shutter 196. The cylinders 212 of the damper holder 198 are actuated to move the grip plates 216 toward each other to grip the second lowermost damper 24*a* and other dampers 24*a* thereabove. Then, the lifting/lowering cylinder 208 is actuated to displace the vertically movable plate 210 upwardly a predetermined distance, lifting the second lowermost damper 24*a* and other dampers 24*a* thereabove, which are gripped by the grip plates 216, off the lowermost damper 24*a* (see FIG. 27).

The lowermost damper 24*a* is now held by the shutter 196. After the second lowermost damper 24*a* and other dampers 24*a* thereabove are lifted to a height large enough not to interfere with a fall of the lowermost damper 24*a*, the cylinders 200 of the shutter 196 are actuated. The angles 204 are displaced away from each other, allowing the damper 24*a* supported by the angles 204 to fall onto the damper inverting and arraying unit 250. Damper 24*a* is guided by the sorter 252 to drop in an upstanding attitude into a right-hand area in the standby station 264 (see FIG. 27).

Then, the shutter 196 is actuated to displace the angles 204 toward each other, after which the lifting/lowering cylinder 208 of the damper holder 198 is actuated to lower the grip plates 216. The dampers 24*a* held by the grip plates 216 are temporarily placed on the angles 204. Then, in the same manner as described above, the damper holder 198 is operated to hold the second lowermost damper 24*a* and other dampers 24*a* thereabove, and retract them upwardly away from the lowermost damper 24*a*. Thereafter, the cylinder 256 of the damper inverting and arraying unit 250 is actuated to angularly move the sorter 252 about the pivot shaft 262.

Then, the shutter 196 is actuated to cause the sorter 252 to guide the damper 24*a*, which has dropped from the angles 204, into a left-side area in the standby station 264, which is opposite to the right-hand side where the preceding damper 24*a* has dropped. The damper 24*a* is held in an upstanding attitude in the left-side area in the standby station 264 (see FIG. 27). In the standby station 264, the two dampers 24*a* are positioned with their bosses 263 confronting each other. The cylinders 266 in the standby station 264 are actuated to displace the support plates 268 away from each other. The two dampers 24*a* on the support plates 268 drop onto the feed base 270, and the chains 272 are moved circulatingly to cause the corresponding pin 274 on the chains 272 to feed the two dampers 24*a* along the feed base 270 in the direction E1 (see FIG. 14).

The two dampers 24*a* fed in the direction E1 by the pin 274 is transferred from the feed base 270 onto the table 286 of the lifter 280. The rotary actuator 282 is actuated to rotate the ball screw 284 which causes the nut 288 to move the table 286 upwardly along the guide rail 290, bringing the two dampers 24*a* on the table 286 into the damper transfer station 292.

In the damper transfer station 292, as shown in FIGS. 15 and 16, the two dampers 24*a* are held by the damper mounting mechanism 28. Specifically, the rotary actuators 296*a*, 296*b* of the damper mounting mechanism 28 have been actuated to rotate the drive pulleys 298*a*, 298*b* to move the belts 302*a*, 302*b* that are trained around the drive pulleys 298*a*, 298*b* and the driven pulleys 300*a*, 300*b*, positioning the clamps 304*a*, 304*b* in the damper transfer station 292.

When the two dampers 24*a* are brought into the damper transfer station 292 by the lifter 280, the clamps 304*a*, 304*b* are positioned at the respective outer ends of the dampers 24*a*. On the clamps 304*a*, 304*b*, the cylinders 310*a*, 310*b* are actuated to move the movable fingers 312*a*, 312*b* toward the fixed fingers 308*a*, 308*b*, clamping the dampers 24*a* between the movable fingers 312*a*, 312*b* and the fixed fingers 308*a*, 308*b*. The clamps 304*a*, 304*b* which have clamped the respective dampers 24*a* are individually actuated by the rotary actuators 296*a*, 296*b* into respective positions that are spaced apart from each other by the axial length of the light-shielded photosensitive roll 11.

Then, the rotary actuator 166 of the product feeder 152 is operated to rotate the third and fourth ball screws 170*a*, 170*b* in the direction to elevate the nuts 172*a*, 172*b* threaded thereover. Since the nuts 172*a*, 172*b* are fixedly mounted on the vertically movable base 174, the vertically movable base 174 are lifted. The light-shielded photosensitive roll 11 placed on the rests 184*a*, 184*b* on the vertically movable base 174 is now brought into vertical alignment with the dampers 24*a*, held by the clamps 304*a*, 304*b*.

The rotary actuators 296*a*, 296*b* are actuated to displace the clamps 304*a*, 304*b* toward each other, inserting the respective dampers 24*a* into the respective opposite ends of the light-shielded photosensitive roll 11. After the dampers 24*a* are inserted into the respective opposite ends of the light-shielded photosensitive roll 11, the clamps 304*a*, 304*b* are moved away from each other, and the rotary actuator 166 of the product feeder 152 is actuated to lower the vertically movable base 174, lowering the light-shielded photosensitive roll 11 in unison with the rests 184*a*, 184*b*.

The rests 346*a*, 346*b* of the third feed mechanism 20 are placed in the damper inserting station 314 (see FIG. 18). Therefore, the light-shielded photosensitive roll 11 with the dampers 24*a* inserted in its opposite ends is transferred from the rests 184*a*, 184*b* onto the rests 346*a*, 346*b* and held on the rests 346*a*, 346*b*. The rotary actuator 338 has been operated to move the belt 344 circulatingly which is trained around the drive and driven pulleys 340, 342, positionally adjusting the rests 346*a*, 346*b* fixed to the belt 344 so as to be spaced from each other by the axial length of the light-shielded photosensitive roll 11.

When the light-shielded photosensitive roll 11 with the dampers 24*a* inserted in its opposite ends is placed on the rests 346*a*, 346*b*, the rotary actuator 320 is operated to cause the belt and pulley means 322 to rotate the rotatable shaft 324 to move the belts 332*a*, 332*b* circulatingly, moving the movable base 334 in the direction C while the movable base 334 is being guided by the guide rails 336*a*, 336*b*. When the rests 346*a*, 346*b* are brought into an end position of their stroke in the direction C, the light-shielded photosensitive roll 11 on the rests 346*a*, 346*b* are placed in the spacer inserting station 348.

Figure 28A:
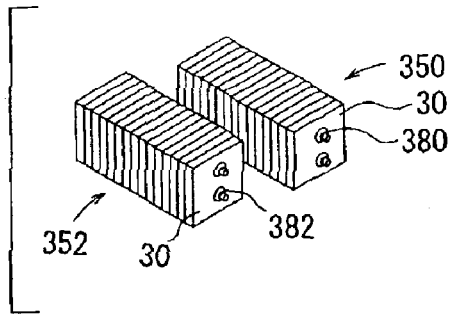
FIGS. 28A through 28D are perspective views illustrative of the manner in which the spacer supply mechanism operates.

In the spacer inserting station 348, as shown in FIGS. 19 and 20, the spacer remover 358 of the spacer supply mechanism 32 is actuated. Specifically, the first cylinder 362 of the spacer remover 358 is operated to move the slide base 372 in the direction opposite to the direction D, displacing the first and second attachment plates 376, 378 fixed to the slide base 372 toward the foremost spacers 30 that are positioned on the distal ends of the arrays of the spacers 30 in the first and second magazines 350, 352 in the direction D. Then, the pairs of the first and second suction pads 380, 382 mounted on the first and second attachment plates 376, 378 attract the foremost spacers 30 positioned on the distal ends of the arrays of the spacers 30 in the first and second magazines 350, 352 in the direction D (see FIG. 28A).

Figure 28B:
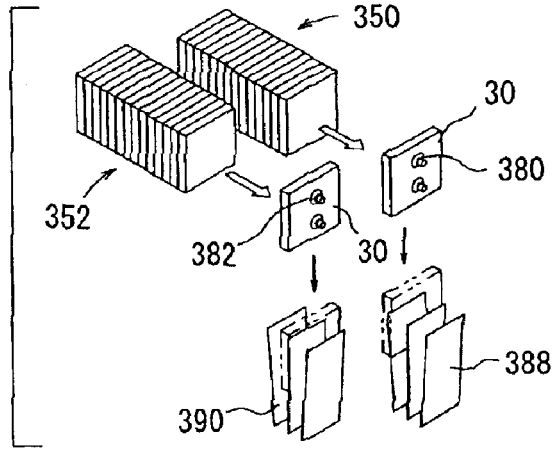

Then, the first cylinder 362 is actuated to move the slide base 372 in the direction D to position the spacers 30 attracted by the first and second suction pads 380, 382 in alignment with upstream spaces provided by the arraying guide plates 388, 390 in the direction D. Then, the spacers 30 are released from the first and second suction pads 380, 382 and drop into the upstream spaces provided by the arraying guide plates 388, 390 (see FIG. 28B).

Figure 28C:
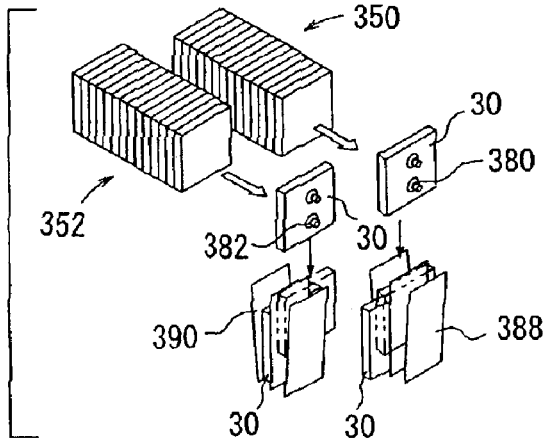

The conveyors 354, 356 are actuated to move the spacers 30 in the first and second magazines 350, 352 to spacer removal positions thereon, after which the first cylinder 362 is actuated to cause the first and second suction pads 380, 382 to attract the foremost spacers 30. The first and second cylinders 362, 368 are actuated to carry the spacers 30 attracted by the first and second suction pads 380, 382 into alignment with downstream upstream spaces provided by the arraying guide plates 388, 390 in the direction D (see FIG. 28C).

The spacers 30 are then released from the first and second suction pads 380, 382 and drop into the downstream upstream spaces provided by the arraying guide plates 388, 390. Therefore, two spacers 30 are arrayed in each set of the arraying guide plates 388, 390 in the direction D.

Figure 28D:
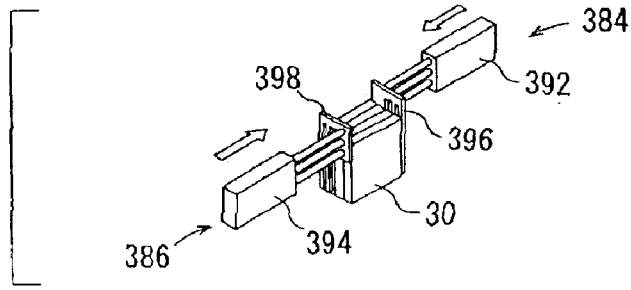
Figure 29:
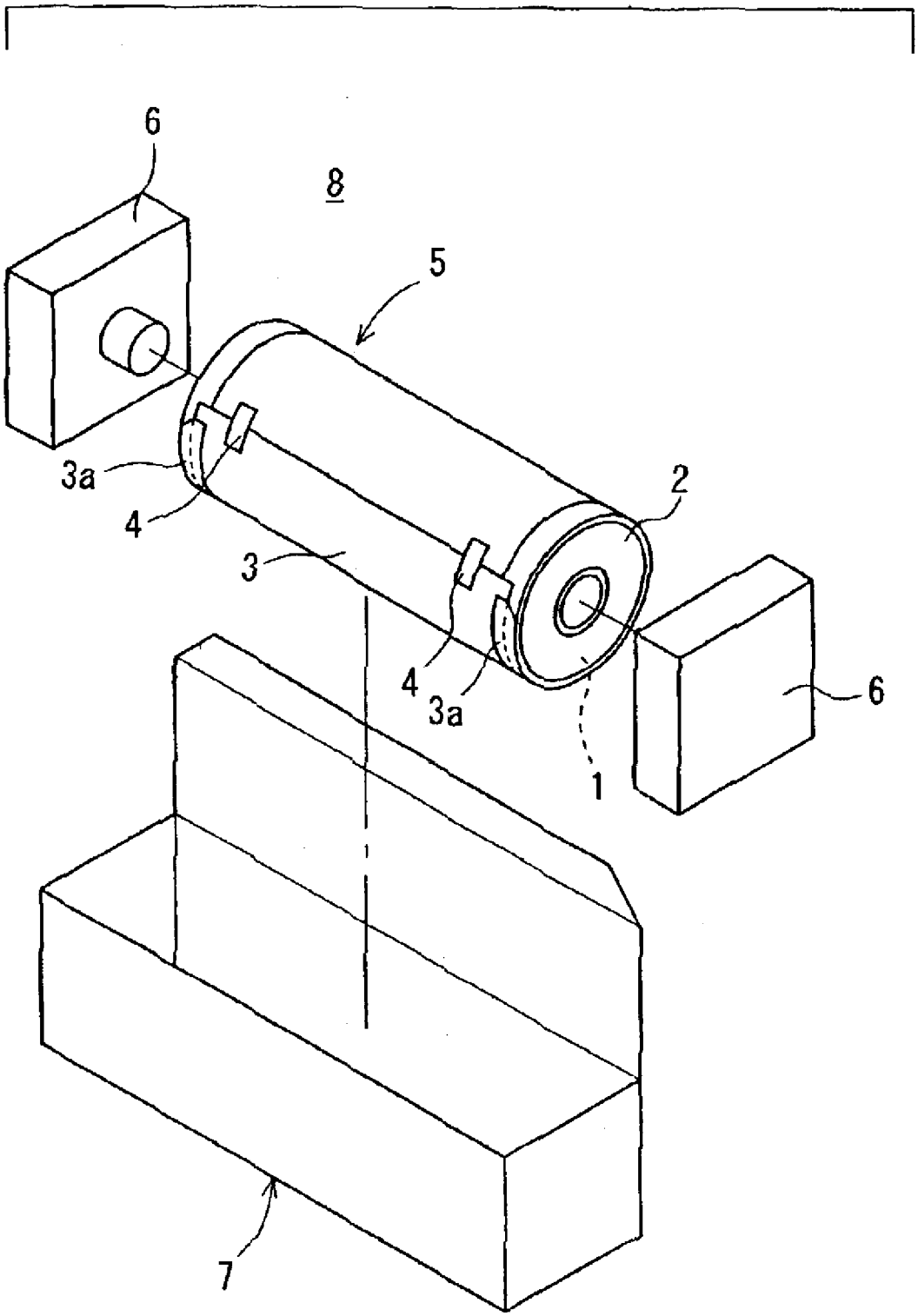
FIG. 29 is an exploded perspective view of a conventional packaged product.

The cylinders 392, 394 of the first and second spacer arraying units 384, 386 are actuated to move the presser plates 396, 398 toward each other. The presser plates 396, 398 move the two spacers arrayed in each set of the arraying guide plates 388, 390 toward each other, combining them into an array of four spacers 30 (see FIG. 28D).

The four spacers 30 are engaged by the swing stopper 399 to prevent themselves from falling down. The pressing cylinder 402 of the spacer supply mechanism 32 is actuated to move the rod 404 thereof in the direction D to cause the insertion plate 406 to press the four spacers 30 in unison with each other in the direction D. The four spacers 30 are inserted on one damper 24*a* mounted on the light-shielded photosensitive roll 11 disposed in the spacer inserting station 348, making up an inner roll assembly 434.

Then, as shown in FIGS. 21 and 22, the cylinder 440 of the roll feed mechanism 436 is actuated to move the slide base 444 in the direction C while the slide base 444 is being guide by the linear guide 446. The support plates 456, 458 supported on the slide base 444 feed the inner roll assembly 434 in the spacer inserting station 348 to the box assembling station 430 and the inner sheet inserting station 410.

When the inner roll assembly 434 is placed in the inner sheet inserting station 410, as shown in FIG. 19, the inner sheet supply mechanism 412 is actuated. In the inner sheet supply mechanism 412, the suction pad 424 attracts a foremost inner sheet 414 disposed on the conveyor 416 in the direction D. The cylinder 420 of the inner sheet remover 418 is actuated to angularly move the swing arm 422 through about 90° to place the inner sheet 414 at the inner roll assembly 434. Then, the inner sheet 414 is released from the suction pad 424 and supplied to a given position on the inner roll assembly 434.

The inner roll assembly 434 to which the inner sheet 414 is supplied in the inner sheet inserting station 410 is then delivered to the box assembling station 430 by the roll feed mechanism 436. While the inner roll assembly 434 is being delivered to the box assembling station 430, the inner roll assembly 434 is prevented from falling down by the spacer keeper guide 432 which extends from the spacer inserting station 348 to the box assembling station 430.

The box assembly station 430 is supplied with a corrugated cardboard box 12*a* as it is unfolded, which is selected depending on the light-shielded photosensitive roll 11, by the packaging member supply mechanism 36. As shown in FIG. 26, the suction pads 504*a*, 504*b* of the second feed line 478 attract the corrugated cardboard box 12*a* and move in the direction indicated by the arrow G when the feed belt 500 is moved circulatingly, placing the corrugated cardboard box 12*a* in the box assembling station 430. The inner roll assembly 434 is fed in the direction C by the roll feed mechanism 436, and placed over the corrugated cardboard box 12*a* while being guided by the engaging plate 476 (see FIG. 21).

Then, the withdrawing suction pads 506*a*, 506*b* of the box assembling mechanism 38 are lifted by the actuator 508, and then attract an outer surface of the bottom panel 480 of the corrugated cardboard box 12*a* placed in the box assembling station 430. The withdrawing suction pads 506*a*, 506*b* as they are attracting the corrugated cardboard box 12*a* are then moved downwardly to fold the corrugated cardboard box 12*a* into a box.

Such a box assembling process will be described below with reference to FIG. 25. The pairs of inner flap folding guides 530*a*, 530*b*, which are spaced apart from each other by the axial length of the light-shielded photosensitive roll 11, have been positioned near the upper end of the box assembling station 430, and the barrel folding guides 532*a*, 532*b* have been disposed across the pairs of inner flap folding guides 530*a*, 530*b*. When the corrugated cardboard box 12*a* is moved downwardly by the withdrawing suction pads 506*a*, 506*b*, the inner flaps 488*a*, 488*b* are folded upwardly in engagement with the inner flap folding guides 530*a*, 530*b*. The barrel panels 482*a*, 482*b* are folded upwardly in engagement with the barrel folding guides 532*a*, 532*b*. Thereafter, the hot-melt adhesive applicators 538*a*, 538*b* apply a hot-melt adhesive 570 to the inner surface of the lower flaps 486.

Upon further descent of the corrugated cardboard box 12*a*, the lower flaps 486 are folded upwardly in engagement with the lower flap folding guides 540*a*, 540*b*, and then bonded to the inner flaps 488*a*, 488*b* by the lower flap folders 541. When the corrugated cardboard box 12*a* reaches its lower stroke end, it is released from the withdrawing suction pads 506*a*, 506*b*. As shown in FIG. 26, the movable guide plate 536 is turned by the cylinder 537 into a horizontal attitude indicated by the two-dot-and-dash line, and the pusher 542 is actuated.

Specifically, as shown in FIGS. 25 and 26, the pressing cylinder 544 of the pusher 542 is actuated to extend the rod 546 in the direction C, causing the pressing plate 548 to push the barrel panel 482*a* of the corrugated cardboard box 12*a* in the direction C. Therefore, the corrugated cardboard box 12*a* is displaced in the direction C. After the top panel 484 of the corrugated cardboard box 12*a* is folded horizontally by the top panel folding guide 550, the corrugated cardboard box 12*a* is delivered onto the belt conveyor 552. On the belt conveyor 552, the hot-melt adhesive applicators 538*c*, 538*d* apply the hot-melt adhesive 570 to the outer surface of the lower flaps 486. Subsequently, the upper flap folding guides 556*a*, 556*b* of the upper flap folder 554 are actuated to fold the upper flaps 490 downwardly into bonded contact with the lower flaps 486.

After the corrugated cardboard box 12*a* has passed through the upper flap folder 554, the top panel fold flap 484*a* is folded downwardly by the folding guide 557. Thereafter, as shown in FIG. 24, the corrugated cardboard box 12*a* is fed upwardly and then fed horizontally in the direction H. While the corrugated cardboard box 12*a* is being fed horizontally in the direction H, the hot-melt adhesive applicator 538*e* applies the hot-melt adhesive 570 to the outer surface of the barrel panel 482*a*. Then, the top panel 484 is pressed against the barrel panel 482*a*, thus completing a packaged product 40.

In the present embodiment, after the light-shielded photosensitive roll 11 which has been manufactured in a preceding process is fed by the first feed mechanism 14 in the direction A, the bar-code information is read from the light-shielded photosensitive roll 11, and the axial length and diameter dimensions of the light-shielded photosensitive roll 11 are measured by the inspection mechanism 16. The measured results and the bar-code information are compared with each other to determine whether the light-shielded photosensitive roll 11 is correct or wrong.

If the light-shielded photosensitive roll 11 is judged as being correct, then the light-shielded photosensitive roll 11 is fed in the direction B by the second feed mechanism 18, and then fed in the direction C by the third feed mechanism 20. Thereafter, the light-shielded photosensitive roll 11 is automatically packaged in the corrugated cardboard box 12*a*, producing a packaged product 40. If the light-shielded photosensitive roll 11 is judged as being wrong by the inspection mechanism 16, then the light-shielded photosensitive roll 11 is discharged onto the stack tray 90 by the rejecting mechanism 78.

As described above, the light-shielded photosensitive roll 11 is measured for its dimensions, and the measured dimensions are checked against the bar-code information read from the light-shielded photosensitive roll 11. Only those light-shielded photosensitive rolls 11 whose dimensions match the bar-code information are fed to a next process (following the third feed mechanism 20) by the second feed mechanism 18. When the bar code 66 is read in the automatic packaging system 10, correct bar-code information corresponding to the light-shielded photosensitive roll 11 is reliably obtained.

Therefore, the number of spacers to be inserted depending on the light-shielded photosensitive roll 11, the selection of the corrugated cardboard box 12*a* or 12*b*, and a facility changeover are free from errors. Various different light-shielded photosensitive rolls 11 can efficiently and automatically be packaged with a simple process and arrangement.

In the present embodiment, since the first and third feed mechanisms 14, 20 are arranged parallel to each other, a desired light-shielded photosensitive roll 11 can be charged directly into the product charge 150 of the third feed mechanism 20 independently of the second feed mechanism 18. Consequently, light-shielded photosensitive rolls 11 which serve as intermediate stock items or work-in-progress products can easily be handled.

In the product charger 150, the bar-code information is read from the charged light-shielded photosensitive roll 11, and the light-shielded photosensitive roll 11 is measured for its dimensions by the inspection mechanism 16. The measured dimensions and the bar-code information are compared with each other to determine whether the charged light-shielded photosensitive roll 11 is correct or wrong. Accordingly, since intermediate stock items or work-in-progress products can directly be charged into the third feed mechanism 20, the automatic packaging system 10 can be used with greater versatility. It is also possible to obtain accurately bar-code information of intermediate stock items or work-in-progress products with a simple process.

The inspection mechanism 16 has the first and second clamps 138, 140 for gripping the longitudinal opposite ends of the light-shielded photosensitive roll 11, the first and second clamps 138, 140 being positionally adjustable depending on the dimension (axial length) of the light-shielded photosensitive roll 11. Therefore, the automatic packaging system 10 can automatically and neatly handle various light-shielded photosensitive rolls 11 of different dimensions without the need for replacing parts.

The second feed mechanism 18 delivers the inspection mechanism 16 which grips the light-shielded photosensitive roll 11 from the first feed mechanism 14 to the third feed mechanism 20. Thus, the light-shielded photosensitive roll 11 to be directly charged into the third mechanism 20 can be inspected by the inspection mechanism 16, so that the automatic packaging system 10 is highly economical.

In the present embodiment, after the dampers 24*a* are automatically mounted on the respective opposite ends of the light-shielded photosensitive roll 11, a given number of spacers 30 are automatically placed on one of the dampers 24*a*. With the inner roll assembly 434 being superposed on the corrugated cardboard box 12*a*, for example, which has been selected depending on the light-shielded photosensitive roll 11, the corrugated cardboard box 12*a* is automatically folded over the inner roll assembly 434, thus automatically manufacturing the packaged product 40.

The process of mounting the dampers 24*a* and inserting the spacers 30 is automatized, allowing various light-shielded photosensitive rolls 11 of different dimensions to be automatically and efficiently packaged with corrugated cardboard boxes 12*a* or 12*b*, and increasing the overall efficiency of the packaging process with ease.

The automatic packaging system 10 has the single first feed line (third feed mechanism 20) for feeding light-shielded photosensitive rolls 11 of different dimensions and the single second feed line 478 for selectively feeding different corrugated cardboard boxes 12*a*, 12*b* from the packaging member supply mechanism 36 to the box assembling station 430. Consequently, the overall facility cost of the automatic packaging system 10 is much smaller than the conventional system which has a plurality of feed lines for respective light-shielded photosensitive rolls 11 of different dimensions and respective different corrugated cardboard boxes 12*a*, 12*b*. The automatic packaging system 10 also takes up a reduced installation space.

The first feed line has the product charger 150 to be charged with light-shielded photosensitive rolls 11 which have been inspected by the inspection mechanism 16 and also charged directly with desired light-shielded photosensitive rolls 11 independently of the inspection mechanism 16. Therefore, any desired light-shielded photosensitive rolls 11 as well as light-shielded photosensitive rolls 11 manufactured in the preceding process and fed by the first feed mechanism 14 can be charged easily, making the automatic packaging system 10 versatile.

The damper supply mechanism 26 has the dedicated magazines 190*a*, 190*b*, 190*c* for individually accommodating dampers 24*a*, 24*b*, and 24*c* that are frequently used and the common magazine 192 for selectively accommodating dampers 24*d* or 24*c* that are less frequently used.

The use of the dedicated magazines 190*a*, 190*b*, 190*c* is advantageous because when the type of light-shielded photosensitive rolls 11 is changed, desired dampers, e.g., dampers 24*b* stored in the dedicated magazine 190*b*, may be removed from the dedicated magazine 190*b*, and the dampers 24*a*, 24*c* stored in the other dedicated magazines 190*a*, 190*c* do not need to be replaced. The efficiency with which to operate the automatic packaging system 10 can be increased because when the type of light-shielded photosensitive rolls 11 is changed, the dampers 24*a* stored in the dedicated magazine 190*a* does not need to be replaced with dampers 24*b*.

The common magazine 192 for selectively accommodating dampers 24*d* or 24*c* that are less frequently used is more effective to reduce the size of the damper supply mechanism 26 than if dedicated magazines were provided to accommodate all the dampers 24*a* through 24*e*. Furthermore, inasmuch as the common magazine 192 selectively accommodates dampers 24*d* or 24*c* that are less frequently used, no frequent switchover is required between the dampers 24*d*, 24*e*, and no substantial efficiency reduction takes place.

The spacer supply mechanism 32 stores a plurality of spacers 30 of one type which are of the same thickness and dimensions. It is only necessary to select the number of spacers 30 depending on the gap between the inner roll assembly 434 and the corrugated cardboard box 12*a* or 12*b*, and hence the process of inserting spacers 30 is effectively simplified. Since the same spacers 30 are used, the process of inserting spacers 30 is automatized with ease, and the cost of the spacers 30 is reduced.

The first and second magazines 350, 352 of the spacer supply mechanism 32 extend parallel to each other in the direction D, and the distal end of the first magazine 350 is spaced forward in the direction D from the distal end of the second magazine 352. Therefore, spacers 30 removed respectively from the first and second magazines 350, 352 are temporarily arranged in staggered relation in the direction D, and when they are pressed toward each other by the first and second spacer arraying units 384, 386, they are superposed one on the other into a neat array. Therefore, the process of supplying spacers 30 is effectively simplified.

While four spacers 30 are inserted at a time, the number of spacers 30 to be inserted is optional. For example, one, two, three, five, or more spacers 30 may be used depending on the axial length of the light-shielded photosensitive roll 11.

According to the present invention, a product is measured for dimensions and checked against bar-code information read from the product. Only those products whose dimensions match the bar-code information are delivered in the second feed direction. Accordingly, the selection of a packaging member and a facility changeover depending on the product are free from errors, and various different products can be packaged efficiently and automatically with a simple process and arrangement.

According to the present invention, the step of mounting dampers on the opposite ends of a product, the step of inserting a given number of spacers, and the step of folding a packaging member over the product that is superposed on the packaging member to produce a packaged product are automatically carried out. Therefore, various products of different dimensions can be packaged automatically and efficiently, resulting in an increase in the efficiency with which to package the products.

Although a certain preferred embodiment of the present invention has been shown and described in detail, it should be understood that various changes and modifications may be made therein without departing from the scope of the appended claims.

What is claimed is:

1. An apparatus for packaging products automatically with packaging members, said products having at least different product lengths or different side dimensions, comprising:

a first feed mechanism for feeding a product manufactured in a preceding process along a first feed direction;

an inspection mechanism for reading bar-code information from said product fed along said first feed direction, wherein the bar-code information is representative of a dimension of said product, measuring the dimension of said product, and comparing the measured dimension with the bar-code information to determine whether the measured dimension and the dimension represented by the bar-code information match;

a second feed mechanism for, if the measured dimension and the dimension represented by the bar-code information match, feeding said product in a second feed direction transverse to said first feed direction; and a third feed mechanism for feeding said product fed in said second feed direction along a third feed direction parallel to said first feed direction.

2. An apparatus according to claim 1, wherein said inspection mechanism comprises:

a gripper for gripping longitudinally opposite ends of said product, said gripper being positionally adjustable depending on the dimension of said product;

an axial length measuring unit for measuring an axial length of said product;

a diameter measuring unit for measuring at least an inside or outside diameter of said product; and a bar-code reader for reading the bar-code information from said product;

the arrangement being such that said second feed mechanism feeds said inspection mechanism which has gripped said product from said first feed mechanism to said third feed mechanism.

3. An apparatus according to claim 1, wherein said third feed mechanism comprises:

a product feeder for automatically feeding said product in said third feed direction; and a product charger for charging said product through said second feed mechanism and charging a desired product independently of said second feed mechanism.

4. An apparatus according to claim 1, further comprising:

a rejecting mechanism for discharging at least the product which is judged as being wrong by said inspection mechanism from said first feed mechanism.

5. An apparatus according to claim 1, further comprising:

a damper supply mechanism for accommodating a plurality of different dampers depending on a dimension of said product;

a damper mounting mechanism for automatically mounting dampers corresponding to said product on opposite ends of said product;

a spacer supply mechanism for accommodating spacers to be placed near one of the ends of said product;

a spacer inserting mechanism for automatically positioning a given number of spacers on the end of said product on which said damper is mounted;

a packaging member supply mechanism for accommodating a plurality of packaging members having different dimensions; and a box assembling mechanism for automatically folding one of said packaging members which is automatically selected depending on said product, over said product superposed on said packaging member to package said product with said packaging member.

6. An apparatus according to claim 5, wherein said damper supply mechanism comprises:

a plurality of dedicated magazines for individually accommodating dampers which are frequently used; and a common magazine for selectively accommodating dampers which are less frequently used.

7. An apparatus according to claim 5, wherein said spacer supply mechanism accommodates a plurality of spacers having the same thickness and dimensions.

8. An apparatus according to claim 7, wherein said spacer supply mechanism comprises:

first and second magazines disposed parallel to each other for accommodating said plurality of spacers, said first and second magazines being structurally identical to each other;

said first and second magazines having distal ends staggered from each other in a direction to deliver the spacers therefrom.

9. An apparatus for packaging products automatically with packaging members, said products having at least different product lengths or different side dimensions, comprising:

a damper supply mechanism for accommodating a plurality of different dampers depending on a dimension of said product;

a damper mounting mechanism for automatically mounting dampers corresponding to said product on respective opposite ends of said product;

a spacer supply mechanism for accommodating spacers to be placed near one of the ends of said product;

a spacer inserting mechanism for automatically positioning a given number of spacers on the end of said product on which said damper is mounted;

a packaging member supply mechanism for accommodating a plurality of packaging members having different dimensions; and a box assembling mechanism for automatically folding one of said packaging members which is automatically selected depending on said product, over said product superposed on said packaging member to package said product with said packaging member.

10. An apparatus according to claim 9, further comprising:

a first feed line for feeding products having different dimensions; and a second feed line for feeding packaging members having different dimensions from said packaging member supply mechanism to said box assembling mechanism.

11. An apparatus according to claim 9, wherein said feed line comprises:

a product feeder for automatically feeding a product which is manufactured in a preceding process; and a product charger for charging a desired product independently of said preceding process.

12. An apparatus according to claim 9, wherein said damper supply mechanism comprises:

a plurality of dedicated magazines for individually accommodating dampers which are frequently used; and a common magazine for selectively accommodating dampers which are less frequently used.

13. An apparatus according to claim 9, wherein said spacer supply mechanism accommodates a plurality of spacers having the same thickness and dimensions.

14. An apparatus according to claim 9, wherein said spacer supply mechanism comprises:

first and second magazines disposed parallel to each other for accommodating said plurality of spacers, said first and second magazines being structurally identical to each other;

said first and second magazines having distal ends staggered from each other in a direction to deliver the spacers therefrom.

* * * * *